US010669967B2

(12) United States Patent
Yoshimura et al.

(10) Patent No.: US 10,669,967 B2
(45) Date of Patent: Jun. 2, 2020

(54) CYLINDER BORE WALL THERMAL INSULATOR, INTERNAL COMBUSTION ENGINE, AND AUTOMOBILE

(71) Applicant: NICHIAS CORPORATION, Tokyo (JP)

(72) Inventors: Akihiro Yoshimura, Hamamatsu (JP); Junya Sato, Hamamatsu (JP); Yoshifumi Fujita, Hamamatsu (JP)

(73) Assignee: NICHIAS CORPORATION, Tokyo (JP)

( * ) Notice: Subject to any disclaimer, the term of this patent is extended or adjusted under 35 U.S.C. 154(b) by 0 days.

(21) Appl. No.: 16/077,127

(22) PCT Filed: Aug. 29, 2017

(86) PCT No.: PCT/JP2017/030911

§ 371 (c)(1),
(2) Date: Aug. 10, 2018

(87) PCT Pub. No.: WO2018/092383

PCT Pub. Date: May 24, 2018

(65) Prior Publication Data

US 2019/0032595 A1 Jan. 31, 2019

(30) Foreign Application Priority Data

Nov. 21, 2016 (JP) ..... 2016-225848

(51) Int. Cl.

| | |
|---|---|
| ***F02F 1/14*** | (2006.01) |
| ***F01P 3/02*** | (2006.01) |
| ***F02F 1/10*** | (2006.01) |

(52) U.S. Cl.

CPC ..... *F02F 1/14* (2013.01); *F01P 3/02* (2013.01); *F02F 1/10* (2013.01); *F01P 2003/021* (2013.01)

(58) Field of Classification Search

CPC ..... F02F 1/14; F02F 1/10; F01P 3/02; F01P 2003/021

See application file for complete search history.

(56) References Cited

U.S. PATENT DOCUMENTS

2003/0035974 A1* 2/2003 Kazuno ..... B29C 45/14778 428/517
2011/0132295 A1* 6/2011 Hamakawa ..... F02F 1/14 123/41.74

(Continued)

FOREIGN PATENT DOCUMENTS

JP 2007-071039 3/2007
JP 2008-031939 2/2008

(Continued)

OTHER PUBLICATIONS

Search Resort issued in EP Appln. No. 17872637.8 dated Dec. 19, 2018.

(Continued)

*Primary Examiner* — Jacob M Amick
*Assistant Examiner* — Charles Brauch
(74) *Attorney, Agent, or Firm* — Nixon & Vanderhye P.C.

(57) ABSTRACT

A cylinder bore wall thermal insulator includes a base member made of synthetic resin and having a shape conforming to a shape of the groove-like cooling water channel (Continued)

in a setting position of the thermal insulator, an opening for heat-sensitive expanding rubber swelling for heat-sensitive expanding rubber disposed on a rear surface side to pass through a base member during heat-sensitive expansion being formed in a position opposed to an insulating part of a cylinder bore wall, heat-sensitive expanding rubber disposed on the rear surface side of the base member and covering the opening for heat-sensitive expanding rubber swelling, and a rear-surface metal plate covering the rear surface side of the heat-sensitive expanding rubber, fixed to the base member, and holding an outer edge portion of the heat-sensitive expanding rubber between the rear-surface metal plate and the base member to thereby fix the heat-sensitive expanding rubber to the base member. An urging member for urging the heat-sensitive expanding rubber after the heat-sensitive expansion toward the cylinder bore wall is attached to the rear-surface metal plate.

According to the present invention, it is possible to provide a thermal insulator that has high adhesion to a wall surface on a cylinder bore side of a groove-like cooling water channel, less easily causes positional deviation in the groove-like cooling water channel, and is easily manufactured.

8 Claims, 19 Drawing Sheets

(56) References Cited

U.S. PATENT DOCUMENTS

| | | | |
|---|---|---|---|
| 2017/0022929 | A1 | 1/2017 | Karita et al. |
| 2017/0030289 | A1 | 2/2017 | Okawa et al. |
| 2017/0045012 | A1 | 2/2017 | Okawa et al. |

FOREIGN PATENT DOCUMENTS

| | | | | |
|---|---|---|---|---|
| JP | 2015-203312 | | 11/2015 | |
| JP | 2015-203313 | | 11/2015 | |
| JP | 2015-203314 | | 11/2015 | |
| JP | 2015203314 | A * | 11/2015 | ..... F01P 3/02 |
| JP | 2015-229988 | | 12/2015 | |
| WO | WO 2015/151822 | | 10/2015 | |
| WO | WO-2015151822 | A1 * | 10/2015 | |

OTHER PUBLICATIONS

International Search Report for PCT/JP2017/030911, dated Oct. 31, 2017, 4 pages (w/ translation).

Written Opinion of the ISA for PCT/JP2017/030911, dated Oct. 31, 2017, 3 pages.

Office Action issued in CN Appln. No. 201780008245.0 dated Feb. 2, 2019 (w/ translation).

* cited by examiner (A)

(B)

(A)

(B)

CYLINDER BORE WALL THERMAL INSULATOR, INTERNAL COMBUSTION ENGINE, AND AUTOMOBILE

This application is the U.S. national phase of International Application No. PCT/JP2017/030911 filed 29 Aug. 2017, which designated the U.S. and claims priority to JP Patent Application No. 2016-225848 filed 21 Nov. 2016, the entire contents of each of which are hereby incorporated by reference.

TECHNICAL FIELD

The present invention relates to a thermal insulator disposed in contact with a wall surface on a groove-like cooling water channel of a cylinder bore wall of a cylinder block of an internal combustion engine, an internal combustion engine including the thermal insulator, and an automobile including the internal combustion engine.

BACKGROUND ART

In an internal combustion engine, the structure of which is such that an explosion of fuel occurs at a top dead point of a piston in a bore and the piston is pushed down by the explosion, temperature rises on an upper side of a cylinder bore wall and temperature falls on a lower side of the cylinder bore wall. Therefore, a difference occurs in a thermal deformation amount between the upper side and the lower side of the cylinder bore wall. Expansion is large on the upper side and, on the other hand, expansion is small on the lower side.

As a result, frictional resistance between the piston and the cylinder bore wall increases. This causes a decrease in fuel efficiency. Therefore, there is a need to reduce the difference in the thermal deformation amount between the upper side and the lower side of the cylinder bore wall.

Therefore, conventionally, in order to uniformize a wall temperature of the cylinder bore wall, it has been attempted to set a spacer in the groove-like cooling water channel for adjusting a water flow of cooling water in the groove-like cooling water channel and controlling cooling efficiency on the upper side and cooling efficiency on the lower side of the cylinder bore wall by the cooling water. For example, Patent Literature 1 discloses a heat medium channel partitioning member for internal combustion engine cooling including: a channel partitioning member disposed in a groove-like heat medium channel for cooling formed in a cylinder block of an internal combustion engine to partition the groove-like heat medium channel for cooling into a plurality of channels, the channel partitioning member being formed at height smaller than the depth of the groove-like heat medium channel for cooling and functioning as a wall section that divides the groove-like heat medium channel for cooling into a bore side channel and a counter-bore side channel; and a flexible rip member formed from the channel partitioning member toward an opening section direction of the groove-like heat medium channel for cooling and formed of a flexible material in a form with a distal end edge portion passing over one inner surface of the groove-like heat medium channel for cooling, whereby, after completion of insertion into the groove-like heat medium channel for cooling, the distal end edge portion comes into contact with the inner wall in an intermediate position in a depth direction of the groove-like heat medium channel for cooling with a deflection restoration force of the distal end edge portion to separate the bore side channel and the counter-bore side channel.

CITATION LIST

Patent Literature

[Patent Literature 1]

Japanese Patent Laid-Open No. 2008-31939 (Claims)

SUMMARY OF INVENTION

Technical Problem

With the heat medium channel partitioning member for internal combustion engine cooling of Cited Literature 1, a certain degree of uniformization of the wall temperature of the cylinder bore wall can be achieved. Therefore, it is possible to reduce the difference in the thermal deformation amount between the upper side and the lower side of the cylinder bore wall. However, in recent years, there is a need to further reduce the difference in the thermal deformation amount between the upper side and the lower side of the cylinder bore wall.

Accordingly, in recent years, uniformization of the wall temperature of the cylinder bore wall is achieved by actively insulating, with the thermal insulator, the wall surface on the cylinder bore side in the middle and lower part of the groove-like cooling water channel of the cylinder block. In order to effectively insulate the wall surface on the cylinder bore side in the middle and lower part of the groove-like cooling water channel, it is demanded that adhesion of the thermal insulator to the wall surface on the cylinder bore side in the middle and lower part of the groove-like cooling water channel is high.

In recent years, there is an increasing demand for selectively insulating a specific portion of the wall surface on the cylinder bore side. To meet such a demand, a thermal insulator of a partial type that insulates a part in a circumferential direction is necessary rather than a thermal insulator of an entire circumference type that insulates the entire circumferential direction of the wall surface on the cylinder bore side. However, the thermal insulator of the partial type has a problem in that the thermal insulator of the partial type easily causes positional deviation in the groove-like cooling water channel compared with the thermal insulator of the entire circumference type. The thermal insulator of the entire circumference type less easily causes positional deviation compared with the partial type but it is not that the thermal insulator of the entire circumference type does not cause positional deviation at all.

Therefore, an object of the present invention is to provide a thermal insulator that has high adhesion to a wall surface on a cylinder bore side of a groove-like cooling water channel and less easily causes positional deviation in the groove-like cooling water channel.

Solution to Problem

The problem is solved by the present invention explained below. That is, the present invention (1) provides a cylinder bore wall thermal insulator set in a groove-like cooling water channel of a cylinder block of an internal combustion engine including cylinder bores and for insulating all bore walls of all the cylinder bores or a part of the bore walls of all the cylinder bores, the thermal insulator including:

a base member made of synthetic resin and having a shape conforming to a shape of the groove-like cooling water channel in a setting position of the thermal insulator, an opening for heat-sensitive expanding rubber swelling for heat-sensitive expanding rubber disposed on a rear surface side to pass through the base member during heat-sensitive expansion being formed in a position opposed to an insulating part of a cylinder bore wall;

heat-sensitive expanding rubber disposed on the rear surface side of the base member and covering the opening for heat-sensitive expanding rubber swelling; and a rear-surface metal plate covering the rear surface side of the heat-sensitive expanding rubber, fixed to the base member, and holding an outer edge portion of the heat-sensitive expanding rubber between the rear-surface metal plate and the base member to thereby fix the heat-sensitive expanding rubber to the base member, wherein an urging member for urging the heat-sensitive expanding rubber after the heat-sensitive expansion toward the cylinder bore wall is attached to the rear-surface metal plate.

The present invention (2) provides a cylinder bore wall thermal insulator set in a groove-like cooling water channel of a cylinder block of an internal combustion engine including cylinder bores and for insulating all bore walls of all the cylinder bores or a part of the bore walls of all the cylinder bores, the thermal insulator including:

a base member made of synthetic resin and having a shape conforming to a shape of the groove-like cooling water channel in a setting position of the thermal insulator, an opening for heat-sensitive expanding rubber swelling for heat-sensitive expanding rubber disposed on a rear surface side to pass through the base member during heat-sensitive expansion being formed in a position opposed to an insulating part of a cylinder bore wall;

heat-sensitive expanding rubber disposed on the rear surface side of the base member and covering the opening for heat-sensitive expanding rubber swelling; and a rear-surface metal plate covering the rear surface side of the heat-sensitive expanding rubber, fixed to the base member, and holding an outer edge portion of the heat-sensitive expanding rubber between the rear-surface metal plate and the base member to thereby fix the heat-sensitive expanding rubber to the base member, wherein a contact member projecting from the rear surface of the base member and for coming into contact with a counter wall of the cylinder bore wall is attached to the rear surface side of base member.

The present invention (3) provides the cylinder bore wall thermal insulator according to (1) or (2), wherein the heat-sensitive expanding rubber is made of a base form material and a thermoplastic substance, and the base form material is silicon rubber, fluorocarbon rubber, natural rubber, butadiene rubber, ethylene propylene diene rubber, or nitrile butadiene rubber, and the thermoplastic substance is resin or a metal material.

The present invention (4) provides an internal combustion engine including a cylinder block in which a groove-like cooling water channel is formed, wherein the cylinder bore wall thermal insulator according to any one of (1) to (3) is set in the groove-like cooling water channel.

The present invention (5) provides an automobile including the internal combustion engine according to (4).

Advantageous Effects of Invention

According to the present invention, it is possible to provide a thermal insulator that has high adhesion to a wall surface on a cylinder bore side of a groove-like cooling water channel and less easily causes positional deviation in the groove-like cooling water channel.

DESCRIPTION OF EMBODIMENTS

Figure 1:
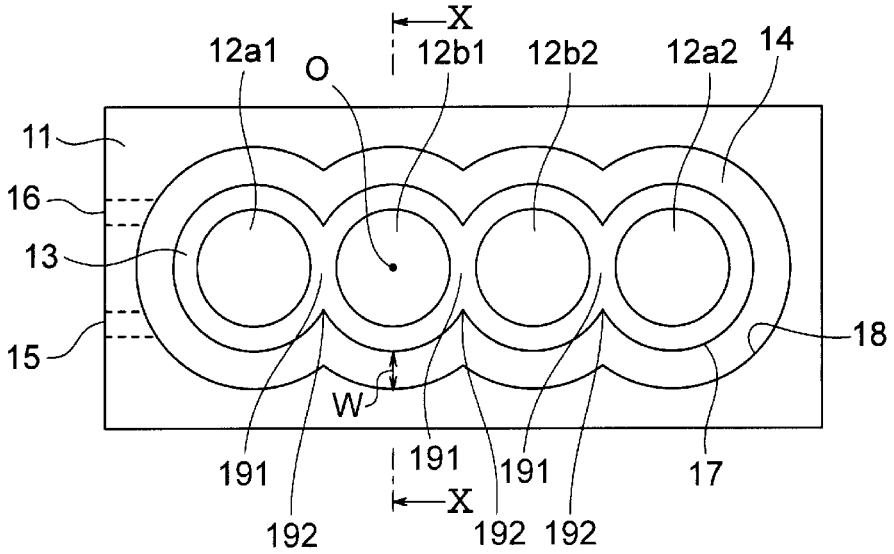
FIG. 1 is a schematic plan view showing a form example of a cylinder block in which a cylinder bore wall thermal insulator of the present invention is set.
Figure 2:
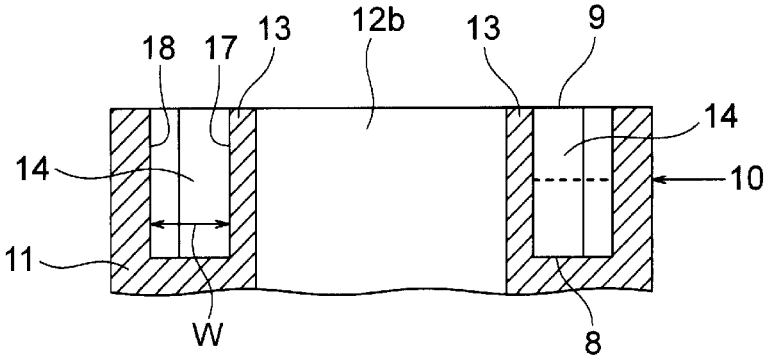
FIG. 2 is an x-x line sectional view of FIG. 1.
Figure 3:
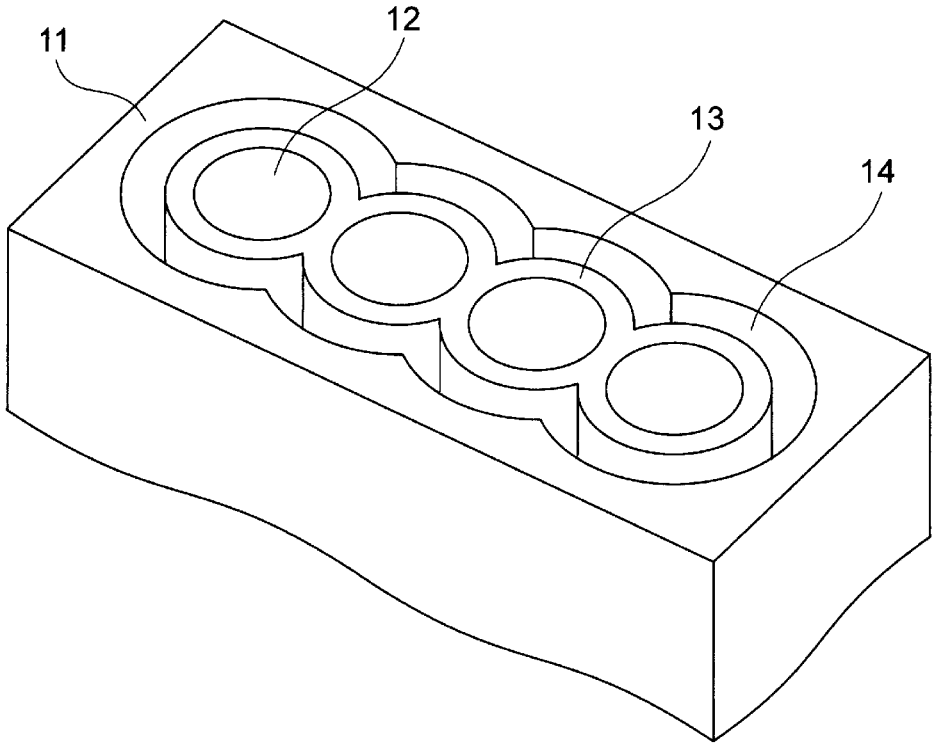
FIG. 3 is a perspective view of the cylinder block shown in FIG. 1.
Figure 4:
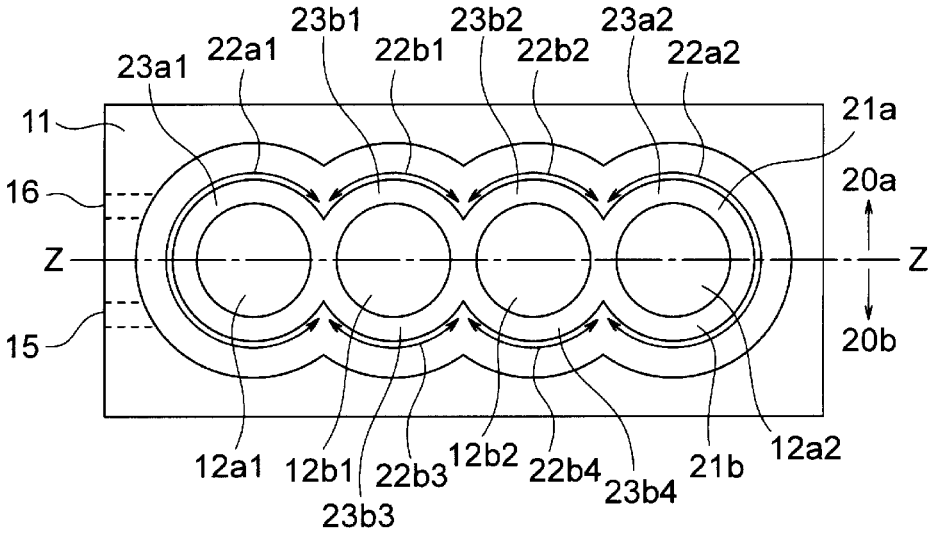
FIG. 4 is a schematic plan view showing a form example of the cylinder block in which the cylinder bore wall thermal insulator of the present invention is set.
Figure 5:
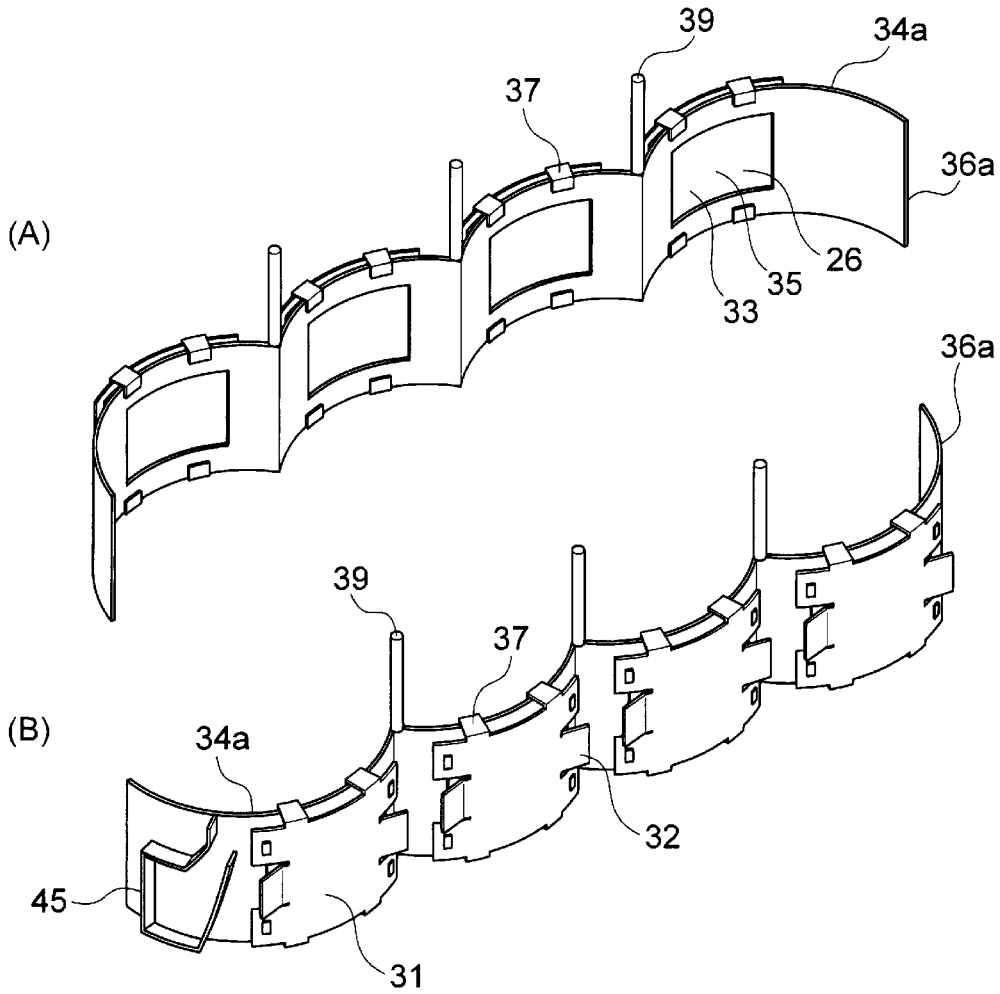
FIG. 5 is a schematic perspective view showing a form example of the cylinder bore wall thermal insulator of the present invention.
Figure 6:
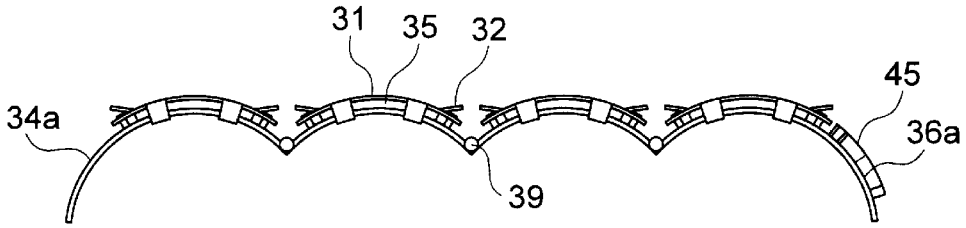
FIG. 6 is a plan view of the cylinder bore wall thermal insulator 36*a* shown in FIG. 5 viewed from an upper side.
Figure 7:
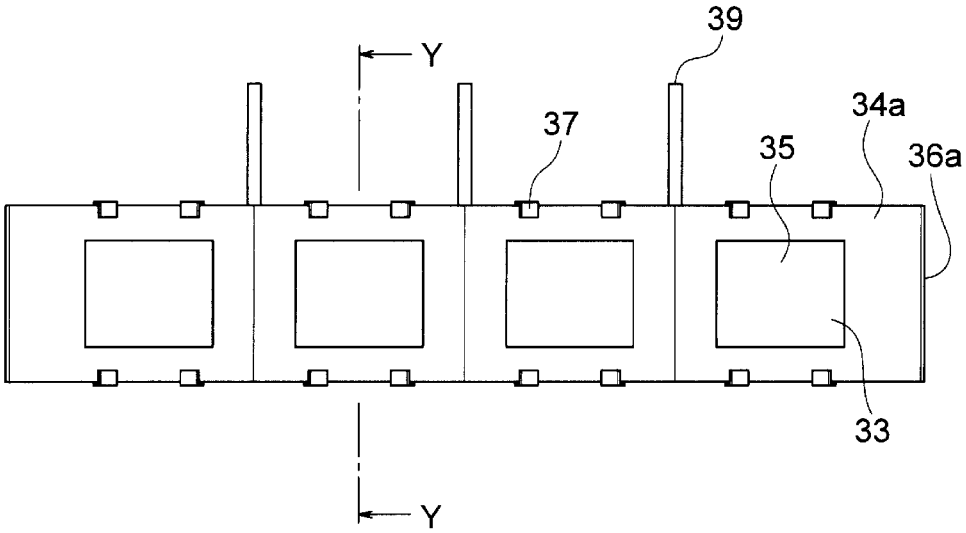
FIG. 7 is a side view of the cylinder bore wall thermal insulator 36*a* shown in FIG. 5 viewed from an inner side.
Figure 8:
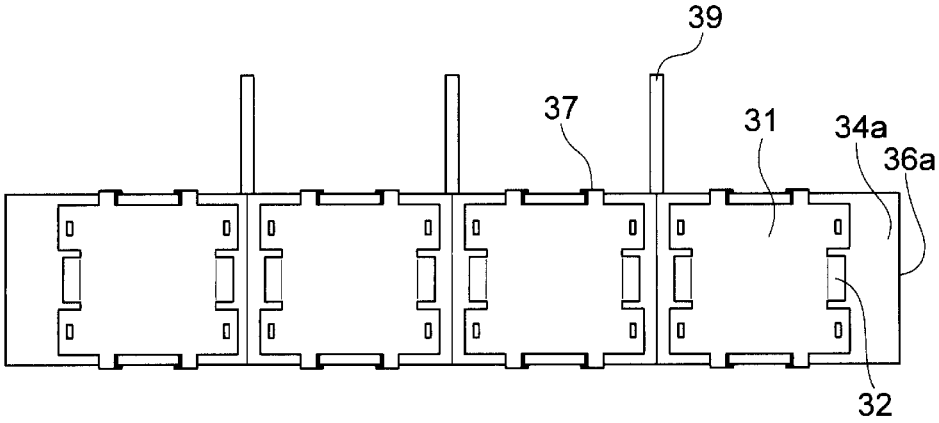
FIG. 8 is a side view of the cylinder bore wall thermal insulator 36*a* shown in FIG. 5 viewed from a rear surface side.
Figure 9:
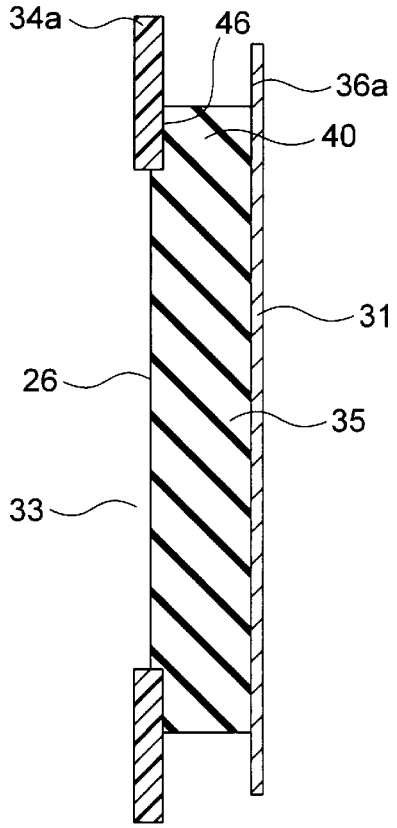
FIG. 9 is a y-y line sectional view of FIG. 7.
Figure 10:
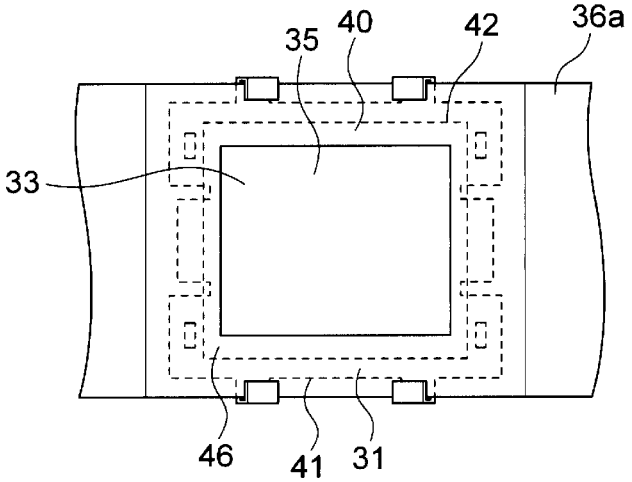
FIG. 10 is a diagram showing a positional relation among members of the cylinder bore wall thermal insulator 36*a* in FIG. 5.
Figure 11:
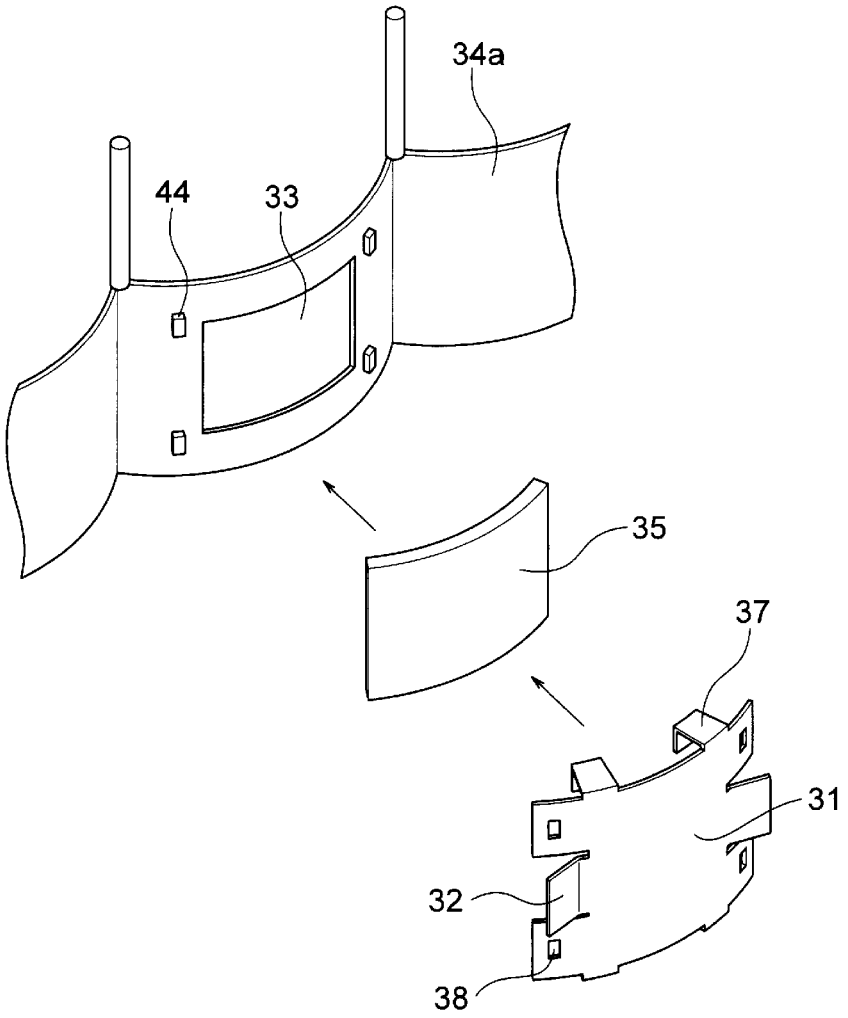
FIG. 11 is a diagram showing a state in which the cylinder bore wall thermal insulator 36*a* shown in FIG. 5 is assembled.
Figure 12:
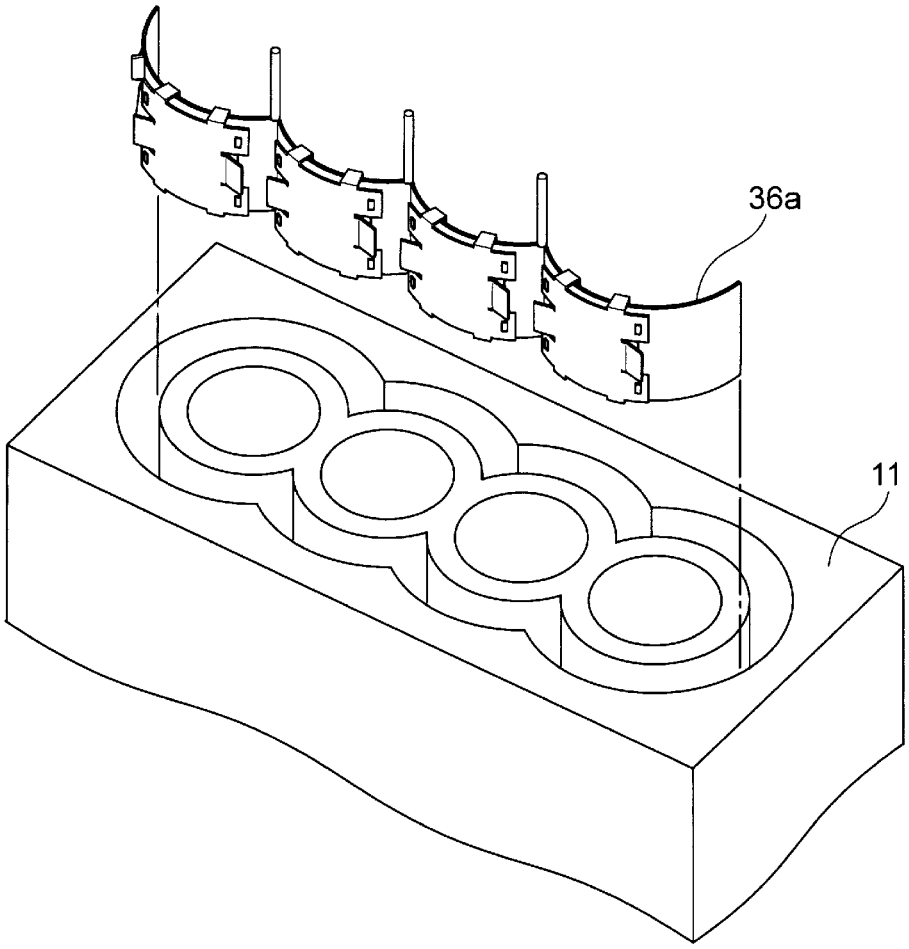
FIG. 12 is a schematic diagram showing a state in which the cylinder bore wall thermal insulator 36*a* is inserted into the cylinder block 11 shown in FIG. 1.
Figure 13:
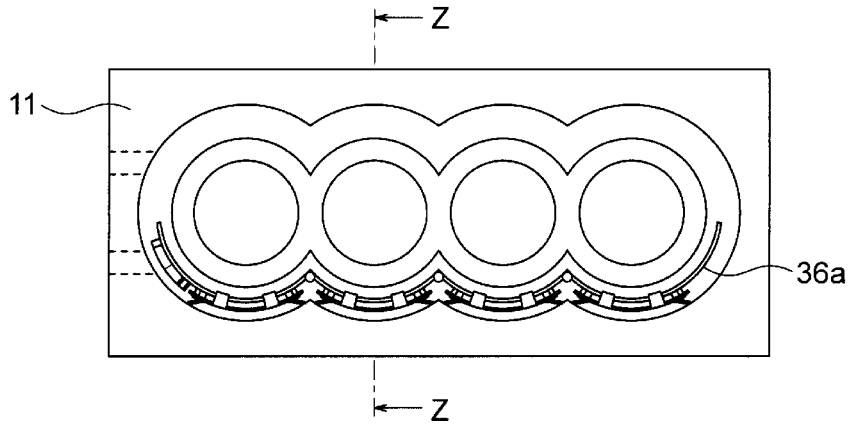
FIG. 13 is a schematic diagram showing a state after the cylinder bore wall thermal insulator 36*a* is set in a groove-like cooling water channel 14 of the cylinder block 11 shown in FIG. 1 and before heat-sensitive expanding rubber expands.
Figure 14:
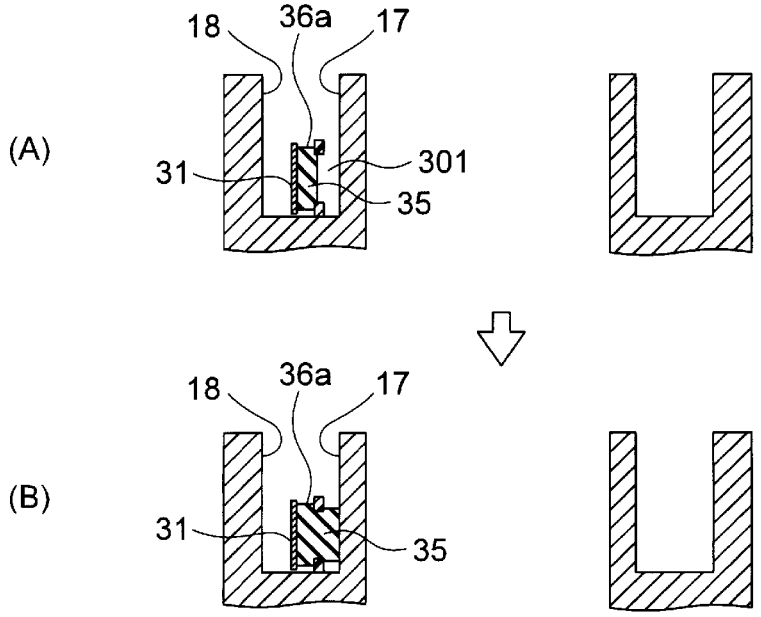
FIG. 14 is a schematic diagram showing a state in which the cylinder bore wall thermal insulator 36*a* is set in the cylinder block 11 shown in FIG. 1.
Figure 15:
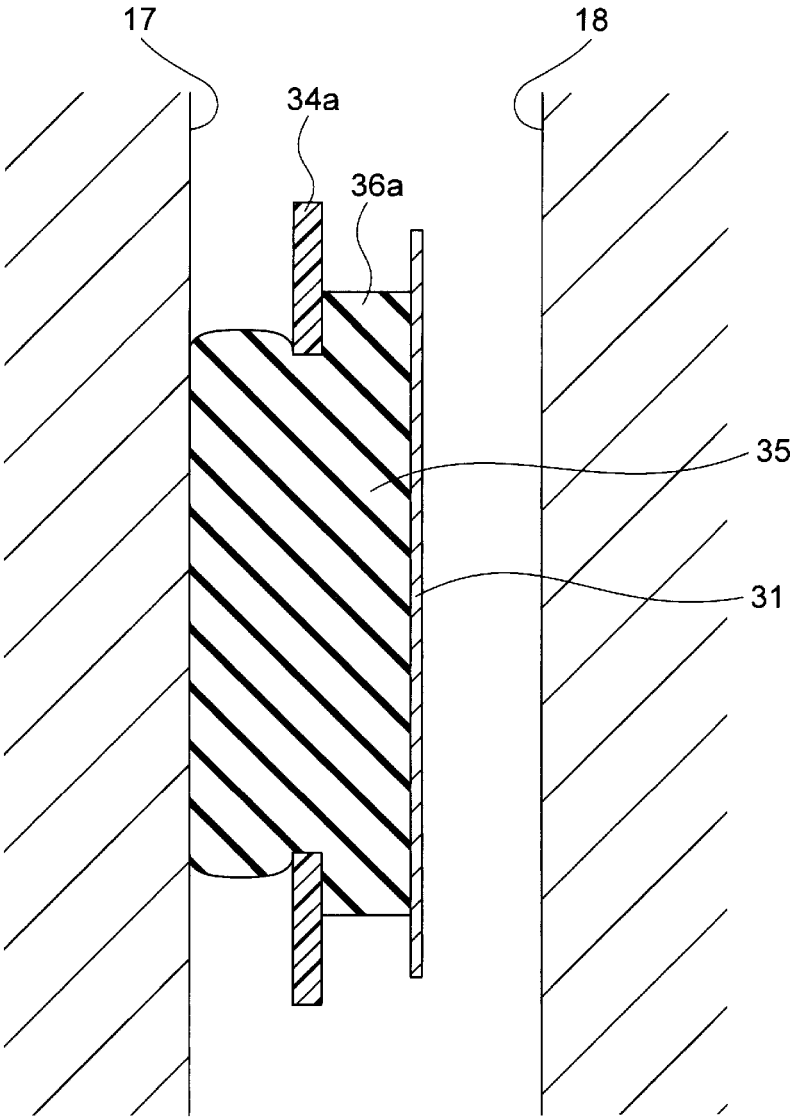
FIG. 15 is an enlarged sectional view showing a state in which heat-sensitive expanding rubber 35 expands in the groove-like cooling water channel 14.

A cylinder bore wall thermal insulator of a first form of the present invention and an internal combustion engine of the present invention are explained with reference to FIG. 1 to FIG. 15. FIG. 1 to FIG. 4 show a form example of a cylinder block in which the cylinder bore wall thermal insulator of the first form of the present invention is set. FIG. 1 and FIG. 4 are a schematic plan view showing the cylinder block in which the cylinder bore wall thermal insulator of the first form of the present invention is set. FIG. 2 is an x-x line sectional view of FIG. 1. FIG. 3 is a perspective view of the cylinder block shown in FIG. 1. FIG. 5 is a schematic perspective view showing a form example of the cylinder bore wall thermal insulator of the first form of the present invention. FIG. 6 is a view of a thermal insulator 36*a* shown in FIG. 5 viewed from above. FIG. 7 is a view of the thermal insulator 36*a* shown in FIG. 5 viewed from a side and a view of the thermal insulator 36*a* viewed from the inner side. FIG. 8 is a view of the thermal insulator 36*a* in FIG. 5 viewed from a side and a view of the thermal insulator 36*a* viewed from the rear surface side. FIG. 9 is a y-y line sectional view of FIG. 7. FIG. 10 is a diagram showing a positional relation among members of the thermal insulator 36*a* in FIG. 5. FIG. 11 is a diagram showing a state in which the thermal insulator 36*a* shown in FIG. 5 is assembled. FIG. 12 is a schematic diagram showing a state in which the cylinder bore wall thermal insulator 36*a* is inserted into the cylinder block 11 shown in FIG. 1. FIG. 13 is a schematic diagram showing a state after the cylinder bore wall thermal insulator 36*a* is set in a groove-like cooling water channel 14 of the cylinder block 11 shown in FIG. 1 and before heat-sensitive expanding rubber expands. FIG. 14 is a schematic diagram showing a state in which the cylinder bore wall thermal insulator 36*a* is set in the cylinder block 11 shown in FIG. 1. (A) is a z-z line sectional view in FIG. 13 and a diagram showing a state before the heat-sensitive expanding rubber expands. (B) is a diagram showing a state after the heat-sensitive expanding rubber expands. FIG. 15 is an enlarged sectional view showing a state after heat-sensitive expanding rubber 35 expands in the groove-like cooling water channel 14.

As shown in FIG. 1 to FIG. 3, in a cylinder block 11 of an open deck type of an internal combustion engine for vehicle mounting in which the cylinder bore wall thermal insulator is set, a bore 12 for a piston to move up and down and a groove-like cooling water channel 14 for feeding cooling water are formed. A wall partitioning the bore 12 and the groove-like cooling water channel 14 is a cylinder bore wall 13. In the cylinder block 11, a cooling water supply port 15 for supplying the cooling water to the groove-like cooling water channel 11 and a cooling water discharge port 16 for discharging the cooling water from the groove-like cooling water channel 11 are formed.

In the cylinder block 11, two or more bores 12 are formed side by side in series. Therefore, as the bores 12, there are end bores 12*a*1 and 12*a*2 adjacent to one bore and intermediate bores 12*b*1 and 12*b*2 sandwiched by two bores (note that, when the number of bores of the cylinder block is two, there are only the end bores). Among bores formed side by side in series, the end bores 12*a*1 and 12*a*2 are bores at both ends. The intermediate bores 12*b*1 and 12*b*2 are bores present between the end bore 12*a*1 at one end and the end bore 12*a*2 at the other end. A wall between the end bore 12*a*1 and the intermediate bore 12*b*1, a wall between the intermediate bore 12*b*1 and the intermediate bore 12*b*2, and a wall between the intermediate bore 12*b*2 and the end bore 12*a*2 (inter-bore walls 191) are portion sandwiched by two bores. Therefore, since heat is transmitted from two cylinder bores, wall temperature is higher than other walls. Therefore, on a wall surface 17 on the cylinder bore side of the groove-like cooling water channel 14, temperature is the highest near the inter-bore walls 191. Therefore, the temperature of a boundary 192 of the bore walls of the cylinder bores and the vicinity of the boundary 192 is the highest in the wall surface 17 on the cylinder bore side of the groove-like cooling water channel 14.

In the present invention, in a wall surface of the groove-like cooling water channel 14, a wall surface on the cylinder bore 13 side is described as the cylinder bore wall 17 of the groove-like cooling water channel. In the wall surface of the groove-like cooling water channel 14, a wall surface on the opposite side of the cylinder bore wall 17 of the groove-like cooling water channel is described as counter wall 18 of the cylinder bore wall.

In the present invention, a one-side half indicates a half on one side at the time when the cylinder block is vertically divided into two in a direction in which the cylinder bores are disposed side by side. Therefore, in the present invention, bore walls on the one-side half among the bore walls of all the cylinder bores indicate bore walls in the half on the one side at the time when all the cylinder bore walls are vertically divided into two in the direction in which the cylinder bores are disposed side by side. For example, in FIG. 4, the direction in which the cylinder bores are disposed side by side is a Z-Z direction. Each of bore walls in one-side halves at the time when the cylinder bore wall is divided into two by this Z-Z line is a bore wall in a one-side half among the bore walls of all the cylinder bores. That is, in FIG. 4, the bore wall in a one-side half further on the 20*a* side than the Z-Z line is a bore wall 21*a* in one one-side half among the bore walls of all the cylinder bores. The bore wall in a one-side half further on the 20*b* side than the Z-Z line is a bore wall 21*b* in the other one-side half among the bore walls of all the cylinder bores. One side among all the cylinder bore walls indicates either the bore wall 21*a* in the one-side half or the bore wall 21*b* in the one-side half. A part of one side indicates a part of the bore wall 21*a* in the one-side half or a part of the bore wall 21*b* in the one-side half.

In the present invention, the bore walls of the cylinder bores indicate bore wall portions corresponding to individual cylinder bores. In FIG. 4, a range indicated by a double-headed arrow 22*a*1 is a bore wall 23*a*1 of the cylinder bore 12*a*1, a range indicated by a double-headed arrow 22*b*1 is a bore wall 23*b*1 of the cylinder bore 12*b*1, a range indicated by a double-headed arrow 22*b*2 is a bore wall 23*b*2 of the cylinder bore 12*b*2, a range indicated by a double-headed arrow 22*a*2 is a bore wall 23*a*2 of the cylinder bore 12*a*2, a range indicated by a double-headed arrow 22*b*3 is a bore wall 23*b*3 of the cylinder bore 12*b*1, and a range indicated by a double-headed arrow 22*b*4 is a bore wall 23*b*4 of the cylinder bore 12*b*2. That is, the bore wall 23*a*1 of the cylinder bore 12*a*1, the bore wall 23*b*1 of the cylinder bore 12*b*1, the bore wall 23*b*2 of the cylinder bore 12*b*2, the bore wall 23*a*2 of the cylinder bore 12*a*2, the bore wall 23*b*3 of the cylinder bore 12*b*1, and the bore wall 23*b*4 of the cylinder bore 12*b*2 are respectively the bore walls of the cylinder bores.

The cylinder bore wall thermal insulator 36*a* shown in FIG. 5 is a thermal insulator for insulating the bore wall 21*b* in one one-side half (on the 20*b* side) in FIG. 4. The cooling-water-flow partitioning member 45 is attached to the cylinder bore wall thermal insulator 36*a*. The cooling-water-flow partitioning member 45 is a member for partitioning the cooling water supply port 15 and the cooling water discharge port 16 such that, in the cylinder block 11 shown in FIG. 4, the cooling water supplied from the cooling water supply port 15 to the groove-like cooling water channel 14 flows toward an end on the opposite side of the position of the cooling water supply port 15 in the groove-like cooling water channel 14 in the other one-side half on the 20*b* side first without being immediately discharged from the cooling water discharge port 16 present in the vicinity and, when reaching the end on the opposite side of the position of the cooling water supply port 15 of the groove-like cooling water channel 14 in the one-side half on the 20*b* side, turns to the groove-like cooling water channel 14 in the one-side half on the 20*a* side, subsequently, flows toward the cooling water discharge port 16 in the groove-like cooling water channel 14 in the one-side half on the 20*a* side, and is finally discharged from the cooling water discharge port 16. In FIG. 4, a cylinder block of a form is shown in which the cooling water flowing to the end in the groove-like cooling water channel 14 in the one-side half on the 20*a* side is discharged from the cooling water discharge port 16 formed on the lateral side of the cylinder block 11. Besides, for example, there is a cylinder block of a form in which the cooling water flowing from one end to the other end in the groove-like cooling water channel 14 in the one-side half on the 20*a* side flows into a cooling water channel formed in the cylinder head rather than being discharged from the lateral side of the cylinder block.

As shown in FIG. 5 to FIG. 9, the cylinder bore wall thermal insulator 36*a* is a molded body of synthetic resin. When viewed from above, the cylinder bore wall thermal insulator 36*a* is molded into a shape of continuous four arcs. The cylinder bore wall thermal insulator 36*a* includes a base member 34*a* having a shape conforming to a one-side half of the groove-like cooling water channel 14, heat-sensitive expanding rubber 35, and a rear-surface metal plate 31, which is a molded body of a metal plate.

In the base member 34*a*, an opening for heat-sensitive expanding rubber swelling 33 for enabling the heat-sensitive expanding rubber 35 disposed on the rear surface side of the base member 34*a* to pass through the base member during heat-sensitive expansion and swell further to the inner side than the inner side surface of the base member 34*a* is formed for each of bore sections. The cylinder bore wall thermal insulator 36*a* is a thermal insulator for insulating the bore wall 21*b* in the one-side half of the cylinder block 11 shown in FIG. 4. In the bore wall 21*b* in the one-side half of the cylinder block 11, there are four bore walls of the cylinder bores, that is, the bore wall 23*a*1 of the cylinder bore 12*a*1, the bore wall 23*b*3 of the cylinder bore 12*b*1, the bore wall 23*b*4 of the cylinder bore 12*b*2, and the bore wall 23*a*2 of the cylinder bore 12*a*2. In the cylinder bore wall thermal insulator 36*a*, the heat-sensitive expanding rubber 35 is disposed in order to insulate the bore walls of the four cylinder bores. Therefore, in the cylinder bore wall thermal insulator 36*a*, the opening for heat-sensitive expanding rubber swelling 33 is formed in a position corresponding to each of the bore wall 23*a*1 of the cylinder bore 12*a*1, the bore wall 23*b*3 of the cylinder bore 12*b*1, the bore wall 23*b*4 of the cylinder bore 12*b*2, and the bore wall 23*a*2 of the cylinder bore 12*a*2, which are thermal insulation targets.

In FIG. 10, a contour of the heat-sensitive expanding rubber 35 present on the rear surface side of the base member 34*a* is indicated by a dotted line of a reference numeral 42 and the rear-surface metal plate 31 is indicated by a dotted line of a reference numeral 41. As shown in FIG. 10, the heat-sensitive expanding rubber 35 covers the opening for heat-sensitive expanding rubber swelling 33 from the rear surface side and the rear-surface metal plate 31 covers the heat-sensitive expanding rubber 35 from the rear surface side. Therefore, in the cylinder bore wall thermal insulator 36*a*, the rear-surface metal plate 31 is fixed and an outer edge portion 40 of the heat-sensitive expanding rubber 35 is held by the rear-surface metal plate 31 fixed to the base member 34 and a circumferential edge portion 46 of the opening for heat-sensitive expanding rubber swelling 33 of the base member 34*a*, whereby the heat-sensitive expanding rubber 35 is fixed to the base member 34*a*.

The heat-sensitive expanding rubber 35 is a rubber material that is in a state in which a base form material is compressed and bound by a thermoplastic substance before expansion and, by being heated, is released from the binding by thermoplastic resin and expands to a state before the compression, that is, a release state. The heat-sensitive expanding rubber 35 is disposed on the rear surface side of the base member 34*a* and covers the opening for heat-sensitive expanding rubber swelling 33. After being set in the groove-like cooling water channel 14 of the cylinder block 11, the heat-sensitive expanding rubber 35 expands by being heated and, by expanding by the heating (heat-sensitively expanding), passes through the opening for heat-sensitive expanding rubber swelling 33, swells further to the inner side than the inner side surface of the base member 34*a*, and expands until a contact surface 26 comes into contact with the cylinder bore wall of the groove-like cooling water channel 14. The heat-sensitive expanding rubber 35 heat-sensitively expands to cover the wall surface of the cylinder bore wall 17 of the groove-like cooling water channel 14, whereby the cylinder bore wall 17 of the groove-like cooling water channel 14 is insulated. The outer edge portion 40 of the heat-sensitive expanding rubber 35 is held by the circumferential edge portion 46 of the opening for heat-sensitive expanding rubber swelling 33 of the base member 34*a* and the rear-surface metal plate 31, whereby the heat-sensitive expanding rubber 35 is fixed to the base member 34*a*. The heat-sensitive expanding rubber 35 is fixed to the base member 34*a*, whereby the position of the heat-sensitive expanding rubber 35 in the groove-like cooling water channel 14 is determined.

In the cylinder bore wall thermal insulator 36*a*, the rear surface side of the heat-sensitive expanding rubber 35 is covered by the rear-surface metal plate 31. Since the rear surface side of the heat-sensitive expanding rubber 35 is covered by the rear-surface metal plate 31, the heat-sensitive expanding rubber 35 is prevented from expanding toward a counter wall 18 of the cylinder bore wall.

In the cylinder bore wall thermal insulator 36*a*, an urging member 32 is attached to the rear-surface metal plate 31. In the cylinder bore wall thermal insulator 36*a*, metal leaf springs are formed on both lateral sides of the rear-surface metal plate 31. The metal leaf springs are bent, whereby the urging member 32 is formed. The cylinder bore wall thermal insulator 36*a* is set in the groove-like cooling water channel 14 of the cylinder block 11, the heat-sensitive expanding rubber 35 heat-sensitively expands, and the urging member 32 comes into contact with the counter wall 18 of the cylinder bore wall of the groove-like cooling water channel 14 and is elastically deformed, whereby an urging force of the urging member 32 is generated. The heat-sensitive expanding rubber 35 is pressed from the rear surface side toward the cylinder bore wall 17 of the groove-like cooling water channel 14 by the urging force. Consequently, the contact surface 26 of the heat-sensitive expanding rubber 35 adheres to the cylinder bore wall 17 of the groove-like cooling water channel 14.

In the cylinder bore wall thermal insulator 36*a*, a pressing member 39 is erected on the base member 34*a* upward from the base member 34*a*. When the cylinder bore wall thermal insulator 36*a* is set in the groove-like cooling water channel 14, the upper end of the pressing member 39 comes into contact with a cylinder head or a cylinder head gasket. Consequently, movement in the up-down direction of the cylinder bore wall thermal insulator 36*a* in the groove-like cooling water channel 14 is restricted.

The cylinder bore wall thermal insulator 36*a* is set in, for example, the groove-like cooling water channel 14 of the cylinder block 11 shown in FIG. 1. As shown in FIG. 12, the cylinder bore wall thermal insulator 36*a* is inserted into the groove-like cooling water channel 14 of the cylinder block 11. As shown in FIG. 13, the cylinder bore wall thermal insulator 36*a* is set in the groove-like cooling water channel 14. When the cylinder bore wall thermal insulator 36*a* is inserted into the groove-like cooling water channel 14, the heat-sensitive expanding rubber 35 has not expanded yet. Therefore, the width of the cylinder bore wall thermal insulator 36*a* is smaller than the channel width of the groove-like cooling water channel 14. Therefore, when cylinder bore wall thermal insulator 36*a* is inserted into the groove-like cooling water channel 14, the cylinder bore wall thermal insulator 36*a* can be set in the groove-like cooling water channel 14 without large resistance.

After the cylinder bore wall thermal insulator 36*a* is set in the groove-like cooling water channel 14, before heating, as shown in FIG. 14(A), a gap 301 is present between the cylinder bore wall thermal insulator 36*a* and the cylinder bore wall 17. However, as shown in FIG. 14(B), when the heat-sensitive expanding rubber is heated, the heat-sensitive expanding rubber 35 expands until the heat-sensitive expanding rubber 35 comes into contact with the cylinder bore wall 17. At this time, the urging member 32 is elastically deformed and an urging force of the urging member 32 is generated. The rear-surface metal plate 31 presses the heat-sensitive expanding rubber 35 from the rear surface side toward the cylinder bore wall 17 with the urging force.

The cylinder bore wall thermal insulator 36*a* is manufactured by, for example, as shown in FIG. 11, preparing the base member 34*a* in which the opening for heat-sensitive expanding rubber swelling 33 is formed, the heat-sensitive expanding rubber 35 molded into a shape for covering the opening for heat-sensitive expanding rubber swelling 33, and the rear-surface metal plate 31, on the upper side and the lower side of which the bending sections 37 are formed and on the right side and the left side of which fitting openings 38 and leaf spring sections 32 are formed, subsequently, laying the heat-sensitive expanding rubber 35 and the rear-surface metal plate 31 on the base member 34*a* in order, and, subsequently, fitting the fitting openings 38 of the rear-surface metal plate 31 with fitting protrusions 44 formed on the rear surface side of the base member 34*a*, bending the bending sections 37 of the rear-surface metal plate 31, and fixing the rear-surface metal plate 31 to the base member 34*a*. Note that the cylinder bore wall thermal insulator of the present invention is not limited to the cylinder bore wall thermal insulator manufactured by the method explained above.

The cylinder bore wall thermal insulator of a first form of the present invention is a cylinder bore wall thermal insulator set in a groove-like cooling water channel of a cylinder block of an internal combustion engine including cylinder bores and for insulating all bore walls of all the cylinder bores or a part of the bore walls of all the cylinder bores, the thermal insulator including:

a base member made of synthetic resin and having a shape conforming to a shape of the groove-like cooling water channel in a setting position of the thermal insulator, an opening for heat-sensitive expanding rubber swelling for heat-sensitive expanding rubber disposed on a rear surface side to pass through the base member during heat-sensitive expansion being formed in a position opposed to an insulating part of a cylinder bore wall;

heat-sensitive expanding rubber disposed on the rear surface side of the base member and covering the opening for heat-sensitive expanding rubber swelling; and a rear-surface metal plate covering the rear surface side of the heat-sensitive expanding rubber, fixed to the base member, and holding an outer edge portion of the heat-sensitive expanding rubber between the rear-surface metal plate and the base member to thereby fix the heat-sensitive expanding rubber to the base member, wherein an urging member for urging the heat-sensitive expanding rubber after the heat-sensitive expansion toward the cylinder bore wall is attached to the rear-surface metal plate.

The cylinder bore wall thermal insulator of the first form of the present invention is set in the groove-like cooling water channel of the cylinder block of the internal combustion engine. The cylinder block in which the cylinder bore wall thermal insulator of the first form of the present invention is set is a cylinder block of an open deck type in which two or more cylinder bores are formed side by side in series. When the cylinder block is the cylinder block of an open deck type in which two cylinder bores are formed side by side in series, the cylinder block includes cylinder bores including two end bores. When the cylinder block is a cylinder block of an open deck type in which three or more cylinder bores are formed side by side in series, the cylinder block includes cylinder bores including two end bores and one or more intermediate bores. Note that, in the present invention, among the cylinder bores formed in series, bores at both ends are referred to as end bores and a bore sandwiched by other cylinder bores on both sides is referred to as intermediate bore.

A position where the cylinder bore wall thermal insulator of the first form of the present invention is set is a groove-like cooling water channel. In many internal combustion engines, a position equivalent to a middle and lower part of the groove-like cooling water channel of the cylinder bore is a position where the speed of a piston increases. Therefore, it is desirable to insulate the middle and lower part of the groove-like cooling water channel. In FIG. 2, a position 10 near the middle between a top part 9 and a bottom part 8 of the groove-like cooling water channel 14 is indicated by a dotted line. A portion of the groove-like cooling water channel 14 in the lower side of the position 10 near the middle is referred to as middle and lower part of the groove-like cooling water channel. Note that the middle and lower part of the groove-like cooling water channel does not mean a portion below a position right in the middle between the top part and the bottom part of the groove-like cooling water channel and means a portion below the vicinity of the intermediate position between the top part and the bottom part. Depending on the structure of the internal combustion engine, the position where the speed of the piston increases is a position corresponding to a lower part of the groove-like cooling water channel of the cylinder bore. In that case, it is desirable to insulate the lower part of the groove-like cooling water channel. Therefore, it is appropriately selected to which position from the bottom part of the groove-like cooling water channel is insulated by the cylinder bore wall thermal insulator of the first form of the present invention, that is, in which position in the up-down direction of the groove-like cooling water channel the position of the upper end of the rubber member is set.

The cylinder bore wall thermal insulator of the first form of the present invention is a cylinder bore wall thermal insulator for insulating all of the wall surfaces on the cylinder bore side of the groove-like cooling water channel or a part of the wall surfaces on the cylinder bore side of the groove-like cooling water channel when viewed in the circumferential direction. That is, the cylinder bore wall thermal insulator of the first form of the present invention is a cylinder bore wall thermal insulator for insulating all of bore walls of all the cylinder bores or a part of the bore walls of all the cylinder bores when viewed in the circumferential direction. Examples of the cylinder bore wall thermal insulator of the present invention include a thermal insulator for insulating a one-side half of the bore walls of all the cylinder bores as in a form example shown in FIG. 5, a thermal insulator for insulating a part on one side among the bore walls of all the cylinder bores as in a form example shown in FIG. 16, and a thermal insulator for insulating all of the bore walls of all the cylinder bores as in a form example shown in FIG. 17. Note that, in the present invention, a one-side half or a part of one side means a one-side half or a part of one side in the circumferential direction of the cylinder bore wall or the groove-like cooling water channel.

The cylinder bore wall thermal insulator of the first form of the present invention includes the base member, the heat-sensitive expanding rubber, and the rear-surface metal plate.

The base member related to the cylinder bore wall thermal insulator of the first form of the present invention is made of synthetic resin. When viewed from above, the base member has a shape of continuous two or more arcs and has a shape of continuously connected arcs over a range insulated by the heat-sensitive expanding rubber. That is, the base member is a molded body of synthetic resin molded into a shape conforming to the shape of the groove-like cooling water channel in which the cylinder bore wall thermal insulator of the first form of the present invention is set.

The base member is a member to which the rear-surface metal plate is fixed and is a member for holding the outer edge portion of the heat sensitive expanding rubber between the circumferential edge portion of the opening for heat-sensitive expanding rubber swelling of the base member and the rear-surface metal plate in order to fix the heat-sensitive expanding rubber to the base member. That is, the base member is a member to which the heat-sensitive expanding rubber is fixed. The base member is a member, the position of which in the groove-like cooling water channel is fixed by an elastic force of the heat-sensitive expanding rubber and an urging force of the urging member after heat-sensitive expansion to thereby position the heat-sensitive expanding rubber in the groove-like cooling water channel.

In the base member, the opening for heat-sensitive expanding rubber swelling for enabling the heat-sensitive expanding rubber disposed on the rear surface side of the base member to pass through the base member during heat-sensitive expansion and swell further to the inner side than the inner side surface of the base member to allow the contact surface of the heat-sensitive expanding rubber to come into contact with the cylinder bore wall of the groove-like cooling water channel is formed for each of bore sections. Therefore, the opening for heat-sensitive expanding rubber swelling is formed in a position opposed to each of the bore walls of the cylinder bores set as thermal insulation targets. Note that, in the present invention, the bore walls of the cylinder bores indicate bore wall portions corresponding to individual cylinder bores. The bore sections of the base member mean portions of the base member on one bore wall side of the cylinder bores and is equivalent to one arcuate shape forming the base member when viewed from above.

The synthetic resin forming the base member is not particularly limited and is selected as appropriate if the synthetic resin is synthetic resin usually used in a cylinder bore wall thermal insulator or a water jacket spacer set in a groove-like cooling water channel of a cylinder block of an internal combustion engine.

The heat-sensitive expanding rubber related to the cylinder bore wall thermal insulator of the first form of the present invention is a member for heat-sensitively expanding in the groove-like cooling water channel until the contact surface comes into contact with the cylinder bore wall of the groove-like cooling water channel and covering the cylinder bore wall to thereby insulate the cylinder bore wall. The heat-sensitive expanding rubber is molded into a shape that can cover the opening for heat-sensitive expanding rubber swelling from the rear surface side of the base member. The heat-sensitive expanding rubber is disposed such that the outer edge portion is held between the circumferential edge portion of the opening for heat-sensitive expanding rubber swelling of the base member and the rear-surface metal plate and fixed to the base member, whereby the heat-sensitive expanding rubber covers the opening for heat-sensitive expanding rubber swelling of the base member from the rear surface side. The heat-sensitive expanding rubber passes through the opening for heat-sensitive expanding rubber swelling from the rear surface side to the inner side of the base member during heat-sensitive expansion and swells further to the inner side than the inner side surface of the base member and expands until the heat-sensitive expanding rubber comes into contact with the cylinder bore wall of the groove-like cooling water channel.

The heat-sensitive expanding rubber is a rubber material that is in a state in which a base form material is compressed and bound by a thermoplastic substance before expansion and, by being heated, is released from the binding by thermoplastic resin and expands to a state before the compression, that is, a release state. The heat-sensitive expanding rubber (in the compressed state) is a composite body obtained by impregnating a thermoplastic substance having a lower melting point than a base form material in the base form material and compressing the thermoplastic substance. The heat-sensitive expanding rubber is a material, a compressed state of which is maintained by a hardened object of the thermoplastic substance present at least in a surface layer part thereof at the normal temperature and is released when the hardened object of the thermoplastic substance is softened by heating. Examples of the heat-sensitive expanding rubber include heat-sensitive expanding rubber described in Japanese Patent Laid-Open No. 2004-143262.

Examples of the base form material related to the heat-sensitive expanding rubber include various polymeric materials such as rubber, elastomer, thermoplastic resin, and thermosetting resin. Specifically, examples of the base form material include natural rubber, various synthetic rubbers such as chloropropylene rubber, styrene butadiene rubber, nitrile butadiene rubber, ethylene propylene diene terpolymer, silicone rubber, fluorocarbon rubber, and acrylic rubber, various elastomers such as soft urethane, and various thermosetting resins such as hard urethane, phenolic resin, and melamine resin.

As the thermoplastic substance related to the heat-sensitive expanding rubber, a thermoplastic substance, any one of a glass transition point, a melting point, and a softening temperature of which is lower than 120° C., is desirable. Examples of the thermoplastic substance related to the heat-sensitive expanding rubber include thermoplastic resin such as polyethylene, polypropylene, polystyrene, polyvinyl chloride, polyvinylidene chloride, polyvinyl acetate, polyacrylic ester, styrene butadiene copolymer, chlorinated polyethylene, polyvinylidene fluoride, ethylene-vinyl acetate copolymer, ethylene vinyl chloride acrylate copolymer, ethylene-vinyl acetate copolymer, ethylene-vinyl acetate copolymer, nylon, acrylonitrile-butadiene copolymer, polyacrylonitrile, polyvinyl chloride, polychloroprene, polybutadiene, thermoplastic polyimide, polyacetal, polyphenylene sulfide, polycarbonate, and thermoplastic polyurethane and various thermoplastic substances such as low-melting point glass flit, starch, solder, and wax and metal materials such as cast iron, stainless steel, and aluminum.

The thickness of the heat-sensitive expanding rubber is selected as appropriate considering the coefficient of expansion of the heat-sensitive expanding rubber, the width of the groove-like cooling water channel, the distance between the inner side surface of the base member and the cylinder bore wall, the distance between the inner side surface of the rear-surface metal plate and the cylinder bore wall, and the like.

The rear-surface metal plate related to the cylinder bore wall thermal insulator of the first form of the present invention is made of metal and is a molded body of a metal plate. The rear-surface metal plate covers the rear surface side of the heat-sensitive expanding rubber. The shape of the rear-surface metal plate is an arcuate shape when viewed from above. The rear-surface metal plate is a member that holds the outer edge portion of the heat-sensitive expanding rubber between the member and the circumferential edge portion of the opening for heat-sensitive expanding rubber swelling of the base member to thereby fix the heat-sensitive expanding rubber to the base member and prevent the heat-sensitive expanding rubber from expanding to the rear surface side of the base member.

The metal forming the rear-surface metal plate is not particularly limited and is selected as appropriate if the metal is metal usually used in a cylinder bore wall thermal insulator or a water jacket spacer set in a groove-like cooling water channel of a cylinder block of an internal combustion engine. Examples of the material of the rear-surface metal plate include stainless steel (SUS), an aluminum alloy, soft steel, hard steel, and alloy steel.

A method of fixing the rear-surface metal plate to the base member is not particularly limited. Examples of the method include a method of forming bending sections in the rear-surface metal plate, bending the bending sections, and holding the end portion of the base member between the bent bending sections and the rear-surface metal plate to thereby fix the rear-surface metal plate, a method of forming fitting openings in the rear-surface metal plate and fitting the fitting openings with fitting protrusions formed in the base member to thereby fix the rear-surface metal plate, a method of fixing the rear-surface metal plate with metal fittings, a method of fixing the rear-surface metal plate with rivets, and a combination of these methods. That is, the rear-surface metal plate is fixed to the base member via parts for fixing formed in the rear-surface metal plate.

In the cylinder bore wall thermal insulator of the first form of the present invention, an urging member is attached to the rear-surface metal plate. A form of the urging member is not particularly limited. Examples of the urging member include a tabular urging member, a coil-like urging member, a laminated leaf spring, a torsion spring, and elastic rubber. The material of the urging member is not particularly limited. However, stainless steel (SUS), an aluminum alloy, and the like are desirable because an anti-LLC property is satisfactory and strength is high. As the urging member, an urging member made of metal such as a metal leaf spring, a coil spring, a laminated leaf spring, or a torsion spring is desirable.

In the form example shown in FIG. 5, the urging member is a metal leaf spring formed together with parts for fixing (in FIG. 11, bending sections indicated by a reference numeral 37 and fitting openings indicated by a reference numeral 38) for fixing the rear-surface metal plate to the base member when the rear-surface metal plate is machined from a metal plate. However, in the present invention, the urging member is not limited to this. The urging member may be an urging member formed together with the rear-surface metal plate and the parts for fixing when the metal plate is machined into the rear-surface metal plate or may be an urging member manufactured separately from the rear-surface metal plate and attached to the rear-surface metal plate by an appropriate attaching method such as physical fixing such as bonding, welding, or caulking. An attaching position of the urging member is selected as appropriate. It is desirable that, because the urging member can be easily attached to the rear-surface metal plate, the urging member is an urging member machined and manufactured together with the rear-surface metal plate when the metal plate is machined to manufacture the rear-surface metal plate, that is, an urging member integrally molded with the rear-surface metal plate from the metal plate.

The attaching position of the urging member is selected as appropriate. Examples of the attaching positions include the right side and the left side of the rear-surface metal plate, the upper side and the lower side of the rear-surface metal plate, the upper side, the lower side, the left side, and the right side of the rear-surface metal plate, and, in addition to those positions, a position such as the center of the rear-surface metal plate or the vicinity of the center. The number of urging members to be attached is selected as appropriate.

After the cylinder bore wall thermal insulator of the first form of the present invention is set in the groove-like cooling water channel of the cylinder block, the heat-sensitive expanding rubber heat-sensitively expands, whereby the urging member comes into contact with the counter wall of the cylinder bore wall of the groove-like cooling water channel and is elastically deformed. The heat-sensitive expanding rubber is pressed from the rear surface side toward the cylinder bore wall of the groove-like cooling water channel via the rear-surface metal plate by an urging force of the urging member generated by the elastic deformation of the urging member. Consequently, the contact surface of the heat-sensitive expanding rubber adheres to the cylinder bore wall of the groove-like cooling water channel and covers the cylinder bore wall of the groove-like cooling water channel. The cylinder bore wall is insulated.

The cylinder bore wall thermal insulator of the first form of the present invention can include a pressing member erected on the base member upward from the base member. The pressing member is a member, the upper end of which comes into contact with a cylinder head or a cylinder head gasket to thereby restrict movement in the up-down direction of the cylinder bore wall thermal insulator of the present invention in the groove-like cooling water channel when the cylinder bore wall thermal insulator of the first form of the present invention is set in the groove-like cooling water channel.

When the cylinder bore wall thermal insulator of the first form of the present invention is inserted to be set in the groove-like cooling water channel, the heat-sensitive expanding rubber has not expanded yet. Therefore, the width of the cylinder bore wall thermal insulator of the present invention is smaller than the channel width of the groove-like cooling water channel. Therefore, when the cylinder bore wall thermal insulator of the first form of the present invention is inserted into the groove-like cooling water channel, the cylinder bore wall thermal insulator of the first form of the present invention can be set in the groove-like cooling water channel without large resistance.

As in the form example shown in FIG. 5, the cylinder bore wall thermal insulator of the first form of the present invention can include a cooling-water-flow partitioning member on one end side. The cylinder bore wall thermal insulator of the first form of the present invention can also include another member or the like for adjusting a flow of cooling water.

Figure 16:
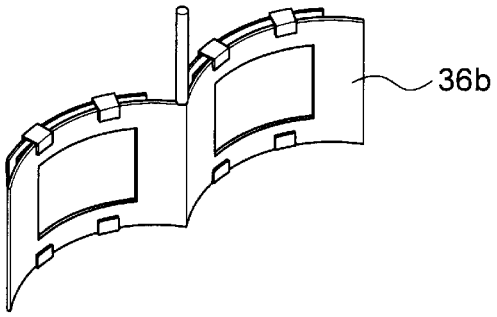
FIG. 16 is a schematic diagram showing a form example of a cylinder bore wall thermal insulator of the present invention.
Figure 16:
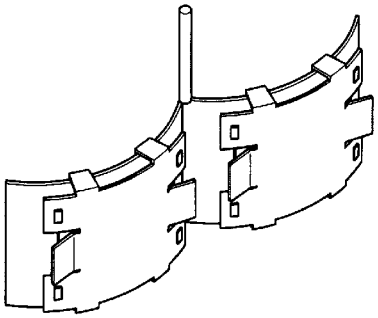
Figure 17:
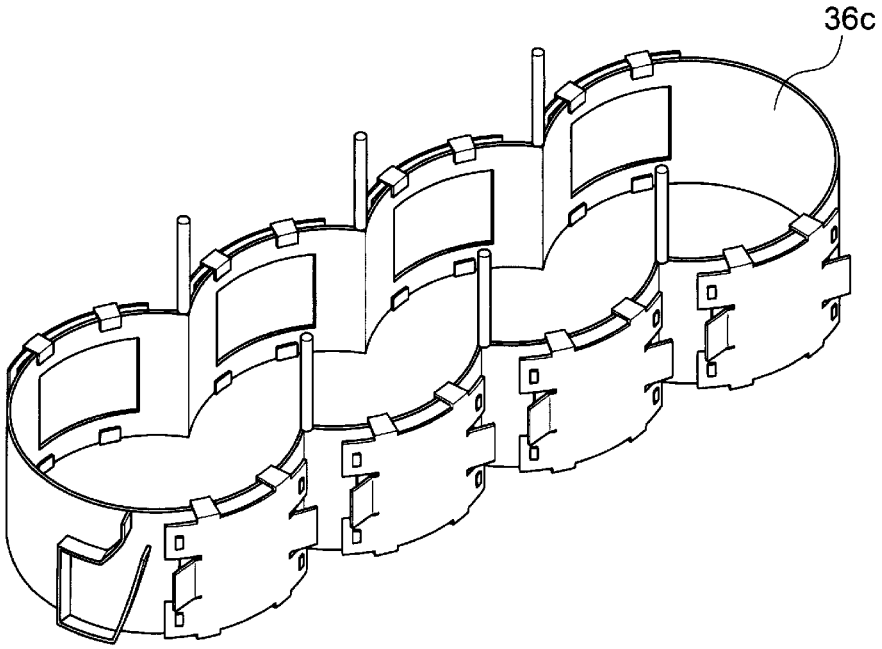
FIG. 17 is a schematic diagram showing a form example of the cylinder bore wall thermal insulator of the present invention.

The cylinder bore wall thermal insulator 36*a* shown in FIG. 5 is a thermal insulator for thermal insulation of bore walls in a one-side half among all the cylinder bore walls of the cylinder block 11 shown in FIG. 4. However, examples of the cylinder bore wall thermal insulator of the first form of the present invention include a thermal insulator for thermal insulation of a part of bore walls on one side among all the cylinder bore walls as in a form example shown in FIG. 16. A cylinder bore wall thermal insulator 36*b* shown in FIG. 16 is a thermal insulator for thermal insulation of a part of the bore walls 21*a* in a one-side half of the cylinder block 11 shown in FIG. 4, that is, bore walls of the cylinder bores 12*b*1 and 12*b*2. Note that FIG. 16 is a schematic perspective view of a form example of the cylinder bore wall thermal insulator of the first form of the present invention. FIG. 16(A) is a perspective view of the cylinder bore wall thermal insulator viewed from obliquely above on the inner side. FIG. 16(B) is a perspective view of the cylinder bore wall thermal insulator viewed from obliquely above on the rear surface side. Examples of the cylinder bore wall thermal insulator of the first form of the present invention include a thermal insulator for thermal insulation of all bore walls of all cylinder bores as in a form example shown in FIG. 17. A cylinder bore wall thermal insulator 36*c* shown in FIG. 17 is a thermal insulator for thermal insulation of all the bore walls of all the cylinder bores of the cylinder block 11 shown in FIG. 4. That is, the cylinder bore wall thermal insulator of the first form of the present invention may be a thermal insulator for thermal insulation of all bore walls of all cylinder bores of a cylinder block or may be a thermal insulator for thermal insulation of a part, for example, a one-side half or a part of one side of the bore walls of all the cylinder bores of the cylinder block. Note that FIG. 17 is a schematic perspective view of a form example of the cylinder bore wall thermal insulator of the first form of the present invention.

Figure 18:
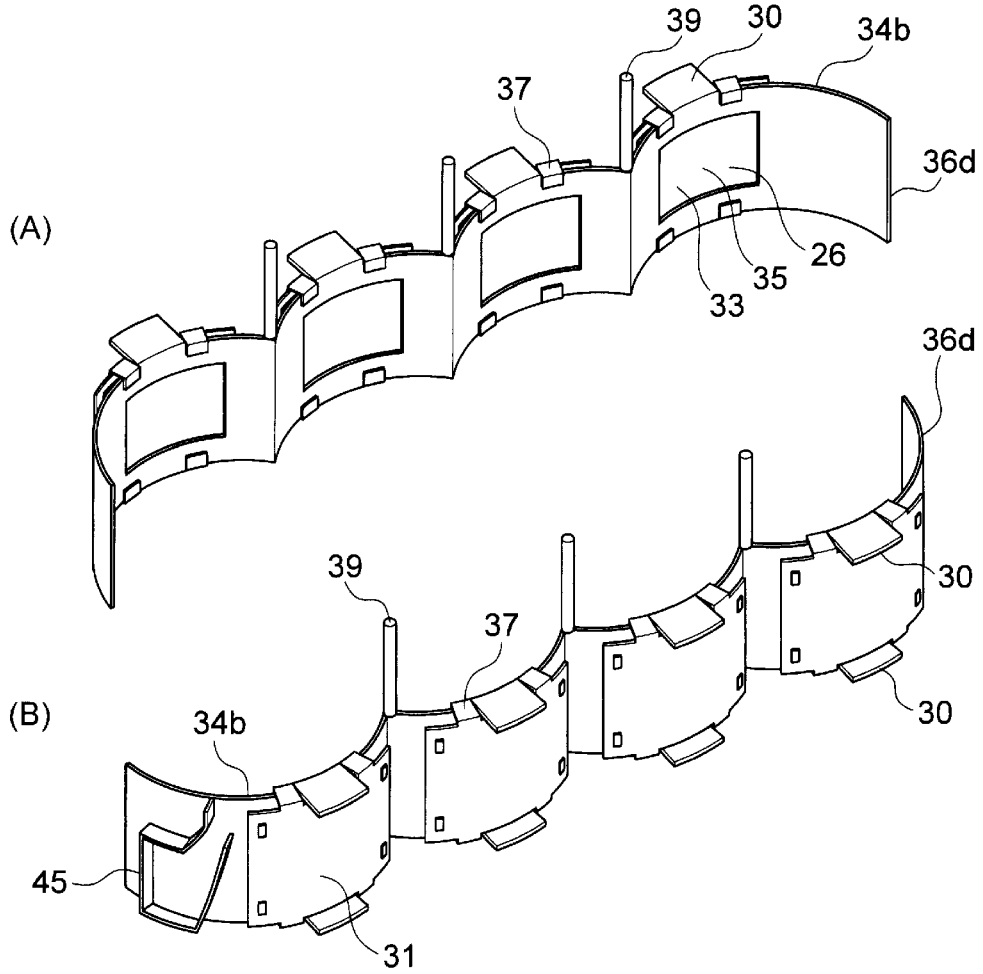
FIG. 18 is a schematic perspective view showing a form example of the cylinder bore wall thermal insulator of the present invention.
Figure 19:
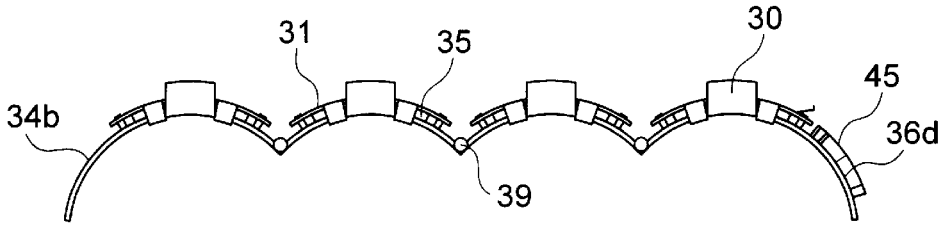
FIG. 19 is a plan view of a cylinder bore wall thermal insulator 36*d* shown in FIG. 18 viewed from the upper side.
Figure 20:
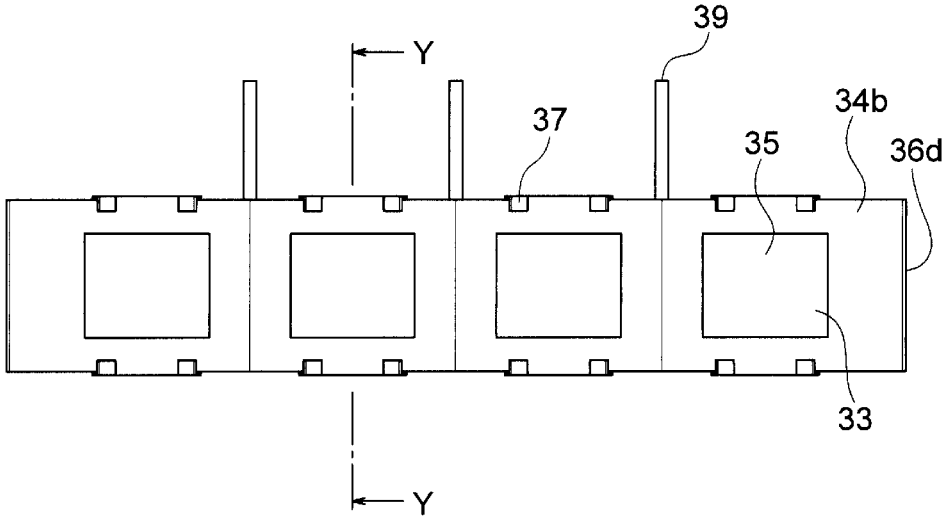
FIG. 20 is a side view of the cylinder bore wall thermal insulator 36*d* shown in FIG. 18 viewed from the inner side.
Figure 21:
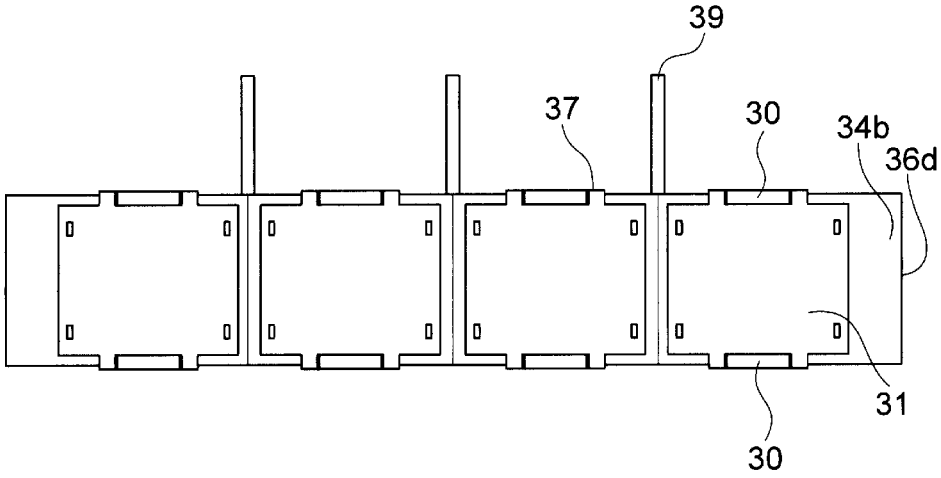
FIG. 21 is a side view of the cylinder bore wall thermal insulator 36*d* shown in FIG. 18 viewed from the rear surface side.
Figure 22:
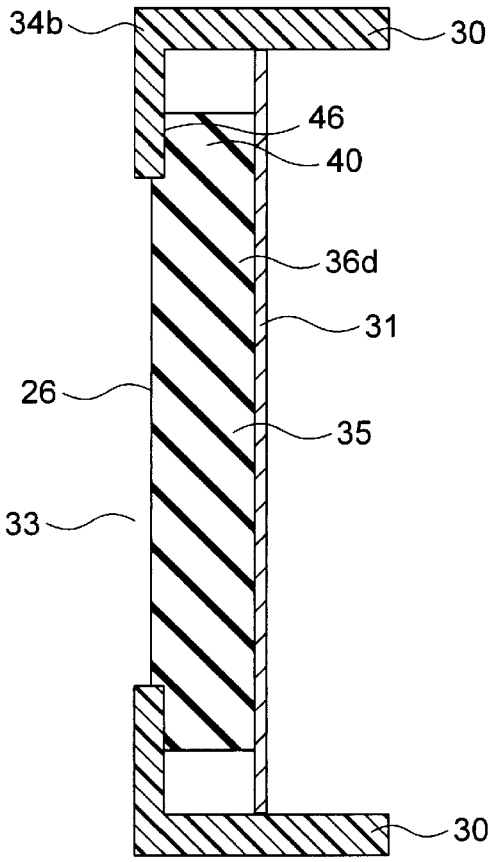
FIG. 22 is a y-y line sectional view of FIG. 20.
Figure 24:
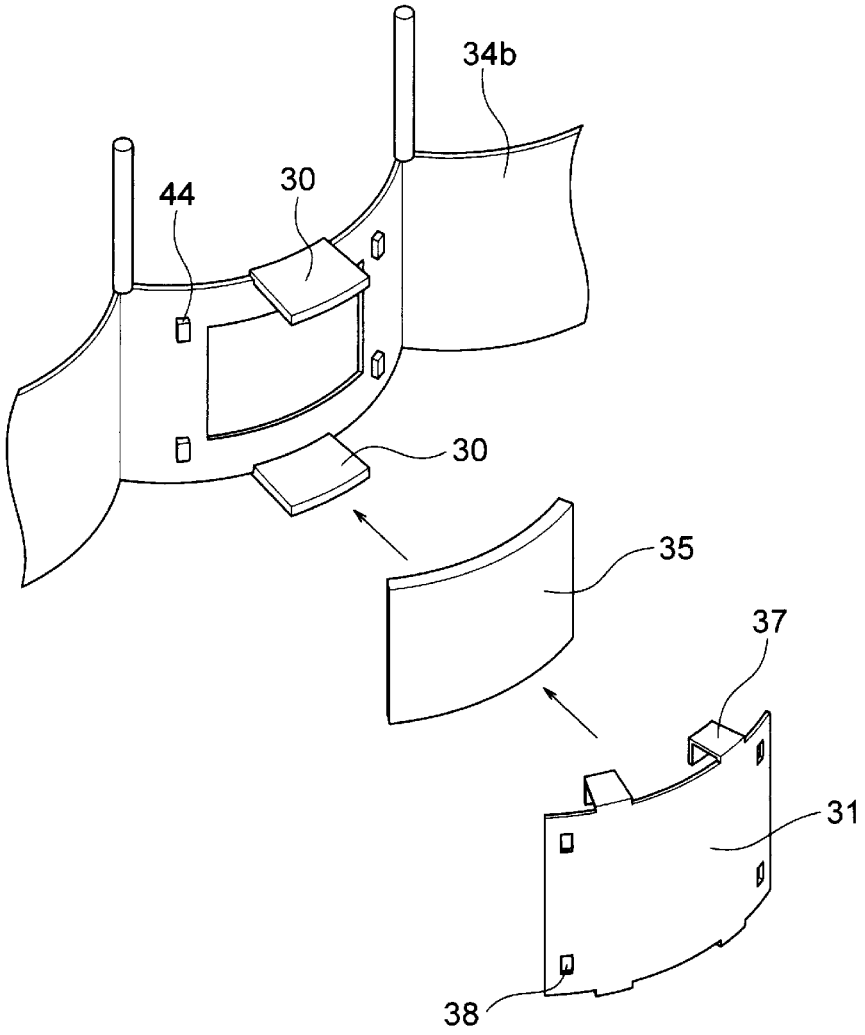
FIG. 24 is a diagram showing a state in which the cylinder bore wall thermal insulator 36*d* shown in FIG. 18 is assembled.
Figure 25:
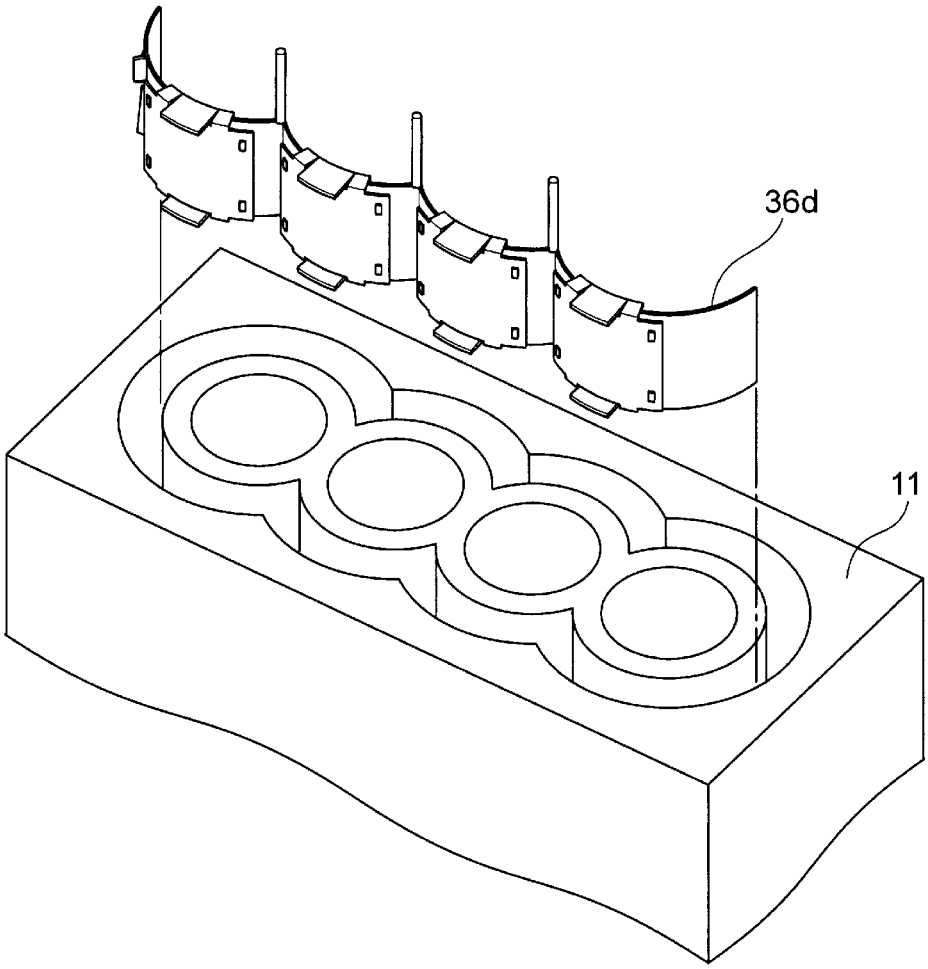
FIG. 25 is a schematic diagram showing a state in which the cylinder bore wall thermal insulator 36*d* is inserted into the cylinder block 11 shown in FIG. 1.
Figure 26:
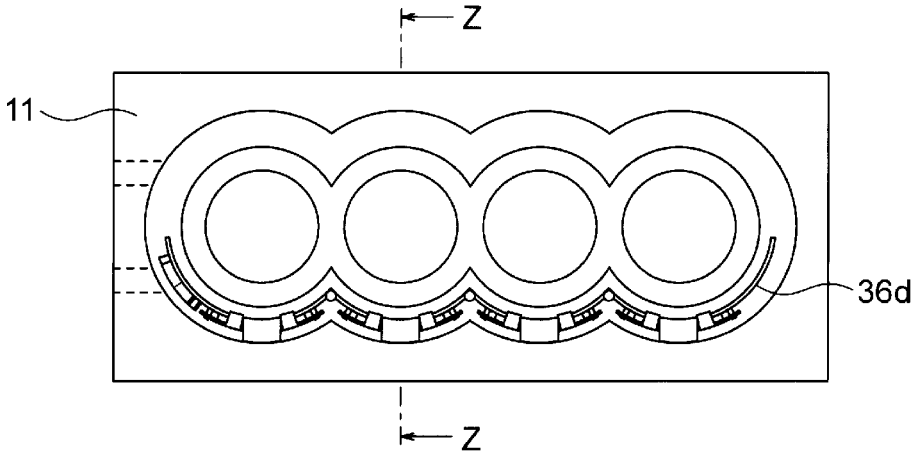
FIG. 26 is a schematic diagram showing a state after the cylinder bore wall thermal insulator 36*d* is set in the groove-like cooling water channel 14 of the cylinder block 11 shown in FIG. 1 and before the heat-sensitive expanding rubber expands.
Figure 27:
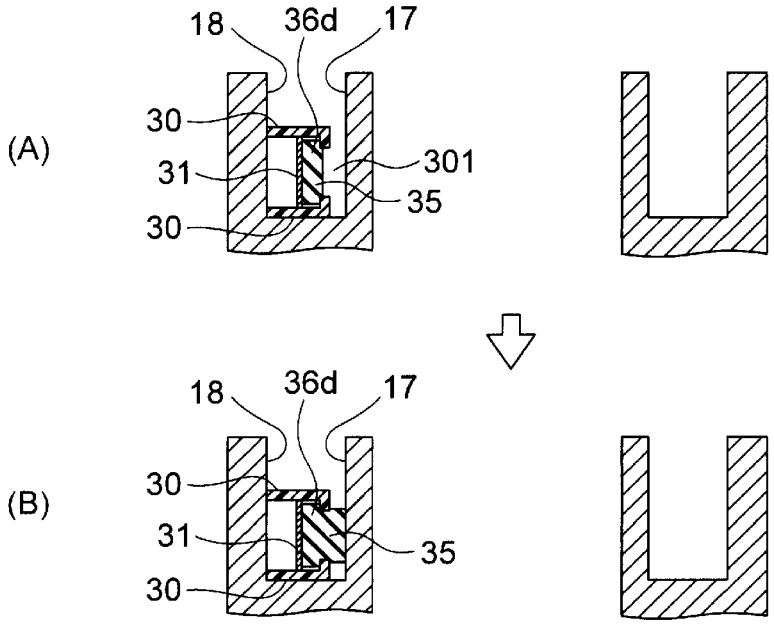
FIG. 27 is a schematic diagram showing a state in which the cylinder bore wall thermal insulator 36*d* is set in the cylinder block 11 shown in FIG. 1.
Figure 28:
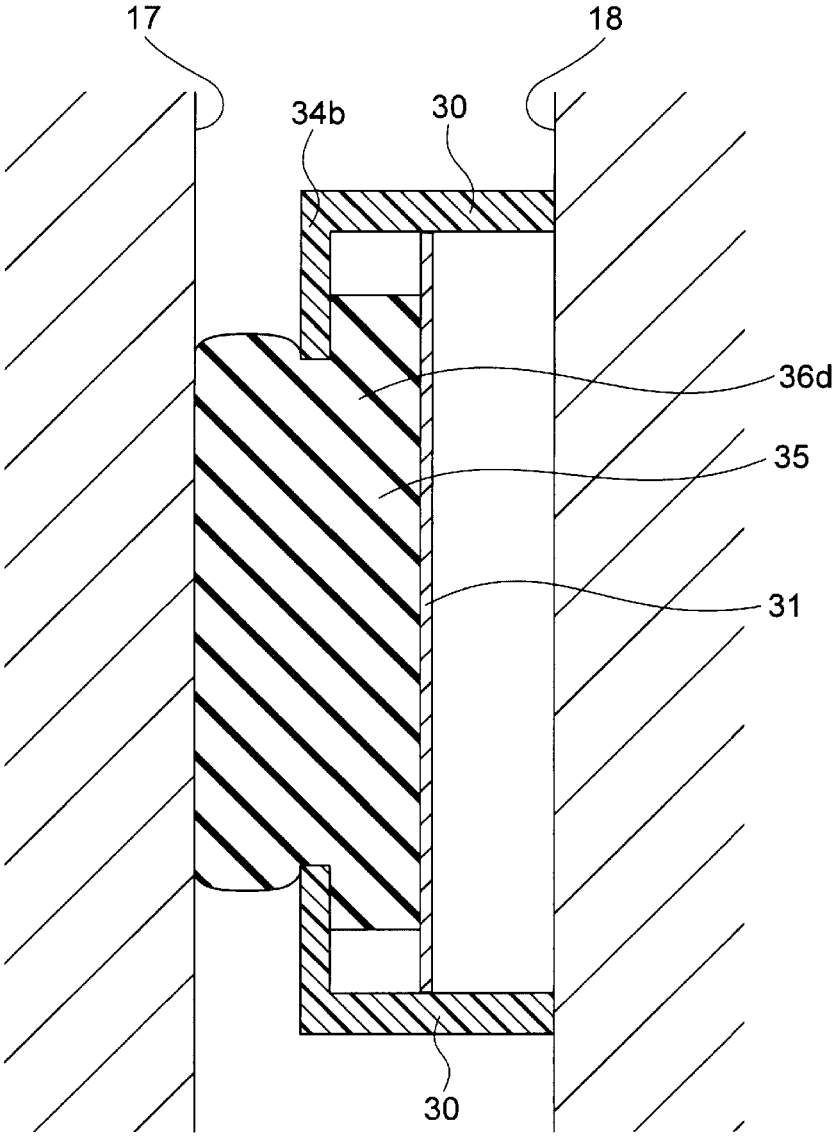
FIG. 28 is an enlarged sectional view showing a state in which the heat-sensitive expanding rubber 35 expands in the groove-like cooling water channel 14.

A cylinder bore wall thermal insulator of a second form of the present invention and an internal combustion engine of the present invention are explained with reference to FIG. 1 to FIG. 4 and FIG. 18 to FIG. 28. FIG. 1 to FIG. 4 show forms examples of a cylinder block in which the cylinder bore wall thermal insulator of the second form of the present invention is set. FIG. 18 is a schematic perspective view showing a form example of the cylinder bore wall thermal insulator of the second form of the present invention. FIG. 19 is a view of a thermal insulator 36*d* in FIG. 18 viewed from above. FIG. 20 is a view of the thermal insulator 36*d* in FIG. 18 viewed from a side and a view of the thermal insulator 36*d* viewed from the inner side. FIG. 21 is a view of the thermal insulator 36*d* in FIG. 18 viewed from a side and a view of the thermal insulator 36*d* viewed from the rear surface side. FIG. 22 is a y-y line sectional view of FIG. 20. FIG. 21 is a diagram showing a positional relation among members of the thermal insulator 36*d* in FIG. 18 and is a view of the thermal insulator 36*d* viewed from the inner side. FIG. 24 is a diagram showing a state in which the thermal insulator 36*d* in FIG. 18 is assembled. FIG. 25 is a schematic diagram showing a state in which the cylinder bore wall thermal insulator 36*d* is inserted into the cylinder block 11 shown in FIG. 1. FIG. 26 is a schematic diagram showing a state after the cylinder bore wall thermal insulator 36*d* is set in the groove-like cooling water channel 14 of the cylinder block 11 shown in FIG. 1 and before the heat-sensitive expanding rubber expands. FIG. 27 is a schematic diagram showing a state in which the cylinder bore wall thermal insulator 36*d* is set in the cylinder block 11 shown in FIG. 1. (A) is a z-z line end face view in FIG. 26 and is a diagram showing a state before the heat-sensitive expanding rubber expands. (B) is a diagram showing a state after the heat-sensitive expanding rubber expands. FIG. 28 is an enlarged sectional view showing a state in which the heat-sensitive expanding rubber 35 expands in the groove-like cooling water channel 14.

As shown in FIG. 1 to FIG. 3, the bores 12 for a piston to move up and down and the groove-like cooling water channel 14 for feeding cooling water are formed in the cylinder block 11 of the open deck type of an internal combustion engine for vehicle mounting in which the cylinder bore wall thermal insulator is set. A wall that partitions the bores 12 and the groove-like cooling water channel 14 is the cylinder bore wall 13. In the cylinder block 11, the cooling water supply port 15 for supplying the cooling water to the groove-like cooling water channel 11 and the cooling water discharge port 16 for discharging the cooling water from the groove-like cooling water channel 11 are formed.

In the cylinder block 11, two or more bores 12 are formed side by side in series. Therefore, the bores 12 include the end bores 12*a*1 and 12*a*2 adjacent to one bore and the intermediate bores 12*b*1 and 12*b*2 sandwiched by two bores (note that, when the number of bores of the cylinder block is two, there are only the end bores). Among the bores formed side by side in series, the end bores 12*a*1 and 12*a*2 are bores at both ends. The intermediate bores 12*b*1 and 12*b*2 are bores present between the end bore 12*a*1 at one end and the end bore 12*a*2 at the other end. A wall between the end bore 12*a*1 and the intermediate bore 12*b*1, a wall between the intermediate bore 12*b*1 and the intermediate bore 12*b*2, and a wall between the intermediate bore 12*b*2 and the end bore 12*a*2 (inter-bore walls 191) are portions sandwiched by two bores. Therefore, since heat is transmitted from two cylinder bores, wall temperature is high compared with other walls. Therefore, on the wall surface 17 on the cylinder bore side of the groove-like cooling water channel 14, temperature is the highest near the inter-bore walls 191. Therefore, the temperature of a boundary 192 of the bore walls of the cylinder bores and the vicinity of the boundary 192 is the highest in the wall surface 17 on the cylinder bore side of the groove-like cooling water channel 14.

In the present invention, in a wall surface of the groove-like cooling water channel 14, a wall surface on the cylinder bore 13 side is described as cylinder bore wall 17 of the groove-like cooling water channel. In the wall surface of the groove-like cooling water channel 14, a wall surface on the opposite side of the wall surface 17 of the groove-like cooling water channel is described as counter wall 18 of the cylinder bore wall.

In the present invention, a one-side half indicates a half on one side at the time when the cylinder block is vertically divided into two in a direction in which the cylinder bores are disposed side by side. Therefore, in the present invention, bore walls on the one-side half among the bore walls of all the cylinder bores indicate bore walls in the half on the one side at the time when all the cylinder bore walls are vertically divided into two in the direction in which the cylinder bores are disposed side by side. For example, in FIG. 4, the direction in which the cylinder bores are disposed side by side is a Z-Z direction. Each of bore walls in one-side halves at the time when the cylinder bore wall is divided into two by this Z-Z line is a bore wall in a one-side half among the bore walls of all the cylinder bores. That is, in FIG. 4, the bore wall in a one-side half further on the 20*a* side than the Z-Z line is the bore wall 21*a* in one one-side half among the bore walls of all the cylinder bores. The bore wall in a one-side half further on the 20*b* side than the Z-Z line is a bore wall 21*b* in the other one-side half among the bore walls of all the cylinder bores. One side among all the cylinder bore walls indicates either the bore wall 21*a* in the one-side half or the bore wall 21*b* in the one-side half. A part of one side indicates a part of the bore wall 21*a* in the one-side half or a part of the bore wall 21*b* in the one-side half.

In the present invention, the bore walls of the cylinder bores indicate bore wall portions corresponding to individual cylinder bores. In FIG. 4, a range indicated by the double-headed arrow 22*a*1 is the bore wall 23*a*1 of the cylinder bore 12*a*1, a range indicated by the double-headed arrow 22*b*1 is the bore wall 23*b*1 of the cylinder bore 12*b*1, a range indicated by the double-headed arrow 22*b*2 is the bore wall 23*b*2 of the cylinder bore 12*b*2, a range indicated by the double-headed arrow 22*a*2 is the bore wall 23*a*2 of the cylinder bore 12*a*2, a range indicated by the double-headed arrow 22*b*3 is the bore wall 23*b*3 of the cylinder bore 12*b*1, and a range indicated by the double-headed arrow 22*b*4 is the bore wall 23*b*4 of the cylinder bore 12*b*2. That is, the bore wall 23*a*1 of the cylinder bore 12*a*1, the bore wall 23*b*1 of the cylinder bore 12*b*1, the bore wall 23*b*2 of the cylinder bore 12*b*2, the bore wall 23*a*2 of the cylinder bore 12*a*2, the bore wall 23*b*3 of the cylinder bore 12*b*1, and the bore wall 23*b*4 of the cylinder bore 12*b*2 are respectively the bore walls of the cylinder bores.

The cylinder bore wall thermal insulator 36*d* shown in FIG. 18 is a thermal insulator for insulating the bore wall 21*b* in one one-side half (on the 20*b* side) in FIG. 4. In the cylinder bore wall thermal insulator 36*d*, a cooling-water-flow partitioning member 45 is attached. The cooling-water-flow partitioning member 45 is a member for partitioning the supply port 15 and the discharge port 16 of the cooling water such that, in the cylinder block 11 shown in FIG. 4, the cooling water supplied from the cooling water supply port 15 to the groove-like cooling water channel 14 flows toward an end on the opposite side of the position of the cooling water supply port 15 first in the groove-like cooling water channel 14 in the one-side half on the 20*b* side without being immediately discharged from the cooling water discharge port 16 present in the vicinity, when coming to the end on the opposite side of the position of the cooling water supply port 15 of the groove-like cooling water channel 14 in the one-side half on the 20*b* side, turns to the groove-like cooling water channel 14 in the one side half on the 20*a* side, and subsequently flows toward the cooling water discharge port 16 in the groove-like cooling water channel 14 in the one side half on the 20*a* side, and is finally discharged from the cooling water discharge port 16. In FIG. 4, the cylinder block of the form is shown in which the cooling water flowing to the end in the groove-like cooling water channel 14 of the one-side half on the 20*a* side is discharged from the cooling water discharge port 16 formed on the lateral side of the cylinder block 11. However, besides, for example, there is a cylinder block of a form in which the cooling water flowing from one end to the other end in the groove-like cooling water channel 14 in the one-side half on the 20*a* side flows into a cooling water channel formed in a cylinder head rather than being discharged from the lateral side of the cylinder block.

As shown in FIG. 18 to FIG. 22, the cylinder bore wall thermal insulator 36*d* is a molded body of synthetic resin. When viewed from above, the cylinder bore wall thermal insulator 36*d* is molded into a shape of continuous four arcs. The cylinder bore wall thermal insulator 36*d* includes the base member 34*b* having a shape conforming to a one-side half of the groove-like cooling water channel 14, the heat-sensitive expanding rubber 35, and the rear-surface metal plate 31, which is a molded body of a metal plate.

In the base member 34*b*, the opening for heat-sensitive expanding rubber swelling 33 for enabling the heat-sensitive expanding rubber 35 disposed on the rear surface side of the base member 34*b* to pass through the base member during heat-sensitive expansion and swell further to the inner side than the inner side surface of the base member 34*b* is formed for each of bore sections. The cylinder bore wall thermal insulator 36*d* is a thermal insulator for insulating the bore wall 21*b* in a one-side half of the cylinder block 11 shown in FIG. 4. In the bore wall 21*b* in the one-side half of the cylinder block 11, there are four bore walls of cylinder bores, that is, the bore wall 23*a*1 of the cylinder bore 12*a*1, the bore wall 23b3 of the cylinder bore 12b1, the bore wall 23b4 of the cylinder bore 12b2, and the bore wall 23a2 of the cylinder bore 12a2. In the cylinder bore wall thermal insulator 36d, the heat-sensitive expanding rubber 35 is disposed in order to insulate the four bore walls of the cylinder bores. Therefore, in the cylinder bore wall thermal insulator 36d, the opening for heat-sensitive expanding rubber swelling 33 is formed in a position corresponding to each of the bore wall 23a1 of the cylinder bore 12a1, the bore wall 23b3 of the cylinder bore 12b1, the bore wall 23b4 of the cylinder bore 12b2, and the bore wall 23a2 of the cylinder bore 12a2, which are thermal insulation targets.

Figure 23:
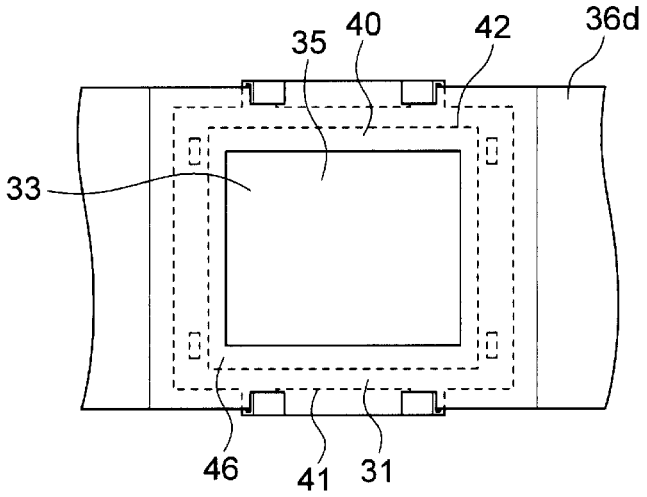
FIG. 23 is a diagram showing a positional relation among members of the cylinder bore wall thermal insulator 36*d* in FIG. 18.

In FIG. 23, a contour of the heat-sensitive expanding rubber 35 present on the rear surface side of the base member 34b is indicated by a dotted line of a reference numeral 42 and the rear-surface metal plate 31 is indicated by a dotted line of a reference numeral 41. As shown in FIG. 23, the heat-sensitive expanding rubber 35 covers the opening for heat-sensitive expanding rubber swelling 33 from the rear surface side and the rear-surface metal plate 31 covers the heat-sensitive expanding rubber 35 from the rear surface side. Therefore, in the cylinder bore wall thermal insulator 36d, the rear-surface metal plate 31 is fixed and the outer edge portion 40 of the heat-sensitive expanding rubber 35 is held by the rear-surface metal plate 31 fixed to the base member 34 and the circumferential edge portion 46 of the opening for heat-sensitive expanding rubber swelling 33 of the base member 34a, whereby the heat-sensitive expanding rubber 35 is fixed to the base member 34b.

The heat-sensitive expanding rubber 35 is a rubber material that is in a state in which a base form material is compressed and bound by a thermoplastic substance before expansion and, by being heated, is released from the binding by thermoplastic resin and expands to a state before the compression, that is, a release state. The heat-sensitive expanding rubber 35 is disposed on the rear surface side of the base member 34a and covers the opening for heat-sensitive expanding rubber swelling 33. After being set in the groove-like cooling water channel 14 of the cylinder block 11, the heat-sensitive expanding rubber 35 expands by being heated and, by expanding by the heating (heat-sensitively expanding), passes through the opening for heat-sensitive expanding rubber swelling 33, swells further to the inner side than the inner side surface of the base member 34b, and expands until the contact surface 26 comes into contact with the cylinder bore wall of the groove-like cooling water channel 14. The heat-sensitive expanding rubber 35 heat-sensitively expands to cover the wall surface of the cylinder bore wall 17 of the groove-like cooling water channel 14, whereby the cylinder bore wall 17 of the groove-like cooling water channel 14 is insulated. The outer edge portion 40 of the heat-sensitive expanding rubber 35 is held by the circumferential edge portion 46 of the opening for heat-sensitive expanding rubber swelling 33 of the base member 34b and the rear-surface metal plate 31, whereby the heat-sensitive expanding rubber 35 is fixed to the base member 34b. The heat-sensitive expanding rubber 35 is fixed to the base member 34b, whereby the position of the heat-sensitive expanding rubber 35 in the groove-like cooling water channel 14 is determined.

In the cylinder bore wall thermal insulator 36d, the rear surface side of the heat-sensitive expanding rubber 35 is covered by the rear-surface metal plate 31. Since the rear surface side of the heat-sensitive expanding rubber 35 is covered by the rear-surface metal plate 31, the heat-sensitive expanding rubber 35 is prevented from expanding toward the counter wall 18 of the cylinder bore wall.

In the cylinder bore wall thermal insulator 36d, a contact member 30 projecting from the rear surface of the base member 34b and for coming into contact with the counter wall 18 of the cylinder bore wall is attached to the rear surface side of the base member 34b. The cylinder bore wall thermal insulator 36d is set in the groove-like cooling water channel 14 of the cylinder block 11 and the heat-sensitive expanding rubber 35 heat-sensitively expands, whereby the contact member 30 comes into contact with the counter wall 18 of the cylinder bore wall of the groove-like cooling water channel. In a state in which the contact member 30 is in contact with the counter wall 18 of the cylinder bore wall, that is, in a state in which the position on the rear surface side of the heat-sensitive expanding rubber 35 is fixed, the contact surface 26 of the heat-sensitive expanding rubber 35 is pressed toward the cylinder bore wall 17 of the groove-like cooling water channel by an elastic force generated by further expansion of the heat-sensitive expanding rubber 35. Consequently, the contact surface 26 of the heat-sensitive expanding rubber 35 adheres to the cylinder bore wall 17 of the groove-like cooling water channel.

In the cylinder bore wall thermal insulator 36d, the pressing member 39 is erected on the base member 34b upward from the base member 34b. When the cylinder bore wall thermal insulator 36d is set in the groove-like cooling water channel 14, the upper end of the pressing member 39 comes into contact with a cylinder head or a cylinder head gasket. Consequently, movement in the up-down direction of the cylinder bore wall thermal insulator 36d in the groove-like cooling water channel 14 is restricted.

The cylinder bore wall thermal insulator 36d is set in, for example, the groove-like cooling water channel 14 of the cylinder block 11 shown in FIG. 1. As shown in FIG. 25, the cylinder bore wall thermal insulator 36d is inserted into the groove-like cooling water channel 14 of the cylinder block 11. As shown in FIG. 26, the cylinder bore wall thermal insulator 36d is set in the groove-like cooling water channel 14. When the cylinder bore wall thermal insulator 36d is inserted into the groove-like cooling water channel 14, the heat-sensitive expanding rubber 35 has not expanded yet. Therefore, the width of the cylinder bore wall thermal insulator 36d is smaller than the channel width of the groove-like cooling water channel 14. Therefore, when cylinder bore wall thermal insulator 36d is inserted into the groove-like cooling water channel 14, the cylinder bore wall thermal insulator 36d can be set in the groove-like cooling water channel 14 without large resistance.

After the cylinder bore wall thermal insulator 36d is set in the groove-like cooling water channel 14, before heating, as shown in FIG. 27(A), the gap 301 is present between the cylinder bore wall thermal insulator 36d and the cylinder bore wall 17. However, as shown in FIG. 27(B), when the heat-sensitive expanding rubber is heated, the heat-sensitive expanding rubber 35 expands until the heat-sensitive expanding rubber 35 comes into contact with the cylinder bore wall 17. According to the expansion of the heat-sensitive expanding rubber 35, the contact member 30 attached to the rear surface side of the cylinder bore wall thermal insulator 36d and projecting toward the counter wall 18 of the cylinder bore wall is pressed against the counter wall 18 of the cylinder bore wall via the rear-surface metal plate 31. The contact member 30 comes into contact with the counter wall 18 of the cylinder bore wall, whereby the position on the rear surface side of the heat-sensitive expanding rubber 35 is fixed. Therefore, the heat-sensitive expanding rubber 35 itself expands, whereby an elastic force is generated. The contact surface 26 of the heat-sensitive expanding rubber 35 is pressed toward the cylinder bore wall 17 by the elastic force.

The cylinder bore wall thermal insulator 36*d* is manufactured by, for example, as shown in FIG. 24, preparing the base member 34*b* in which the opening for heat-sensitive expanding rubber swelling 33 is formed, the heat-sensitive expanding rubber 35 molded into a shape for covering the opening for heat-sensitive expanding rubber swelling 33, and the rear-surface metal plate 31, on the upper side and the lower side of which the bending sections 37 are formed and on the right side and the left side of which the fitting openings 38 are formed, subsequently, laying the heat-sensitive expanding rubber 35 and the rear-surface metal plate 31 on the base member 34*b* in order, and, subsequently, fitting the fitting openings 38 of the rear-surface metal plate 31 with the fitting protrusions 44 formed on the rear surface side of the base member 34*b*, bending the bending sections 37 of the rear-surface metal plate 31, and fixing the rear-surface metal plate 31 to the base member 34*b*. Note that the cylinder bore wall thermal insulator of the present invention is not limited to the cylinder bore wall thermal insulator manufactured by the method explained above.

A cylinder bore wall thermal insulator of a second form of the present invention is a thermal insulator set in a groove-like cooling water channel of a cylinder block of an internal combustion engine including cylinder bores and for insulating all bore walls of all the cylinder bores or a part of the bore walls of all the cylinder bores, the thermal insulator including:

a base member made of synthetic resin and having a shape conforming to a shape of the groove-like cooling water channel in a setting position of the thermal insulator, an opening for heat-sensitive expanding rubber swelling for heat-sensitive expanding rubber disposed on a rear surface side to pass through the base member during heat-sensitive expansion being formed in a position opposed to an insulating part of a cylinder bore wall;

heat-sensitive expanding rubber disposed on the rear surface side of the base member and covering the opening for heat-sensitive expanding rubber swelling; and a rear-surface metal plate covering the rear surface side of the heat-sensitive expanding rubber, fixed to the base member, and holding an outer edge portion of the heat-sensitive expanding rubber between the rear-surface metal plate and the base member to thereby fix the heat-sensitive expanding rubber to the base member, wherein a contact member projecting from the rear surface of the base member and for coming into contact with a counter wall of the cylinder bore wall is attached to the rear surface side of base member.

The cylinder bore wall thermal insulator of the second form of the present invention is set in the groove-like cooling water channel of the cylinder block of the internal combustion engine. The cylinder block in which the cylinder bore wall thermal insulator of the second form of the present invention is set is a cylinder block of an open deck type in which two or more cylinder bores are formed side by side in series. When the cylinder block is a cylinder block of an open deck type in which two cylinder bores are formed side by side in series, the cylinder block includes cylinder bores including two end bores. When the cylinder block is a cylinder block of an open deck type in which three or more cylinder bores are formed side by side in series, the cylinder block includes cylinder bores including two end bores and one or more intermediate bores. Note that, in the present invention, among the cylinder bores formed in series, bores at both ends are referred to as end bores and a bore sandwiched by other cylinder bores on both sides is referred to as intermediate bore.

A position where the cylinder bore wall thermal insulator of the second form of the present invention is set is a groove-like cooling water channel. In many internal combustion engines, a position equivalent to a middle and lower part of a groove-like cooling water channel of a cylinder bore is a position where the speed of a piston increases. Therefore, it is desirable to insulate the middle and lower part of the groove-like cooling water channel. In FIG. 2, the position 10 near the middle between the top part 9 and the bottom part 8 of the groove-like cooling water channel 14 is indicated by a dotted line. A portion of the groove-like cooling water channel 14 in the lower side of the position 10 near the middle is referred to as middle and lower part of the groove-like cooling water channel. Note that the middle and lower part of the groove-like cooling water channel does not mean a portion below a position right in the middle between the top part and the bottom part of the groove-like cooling water channel and means a portion below the vicinity of the intermediate position between the top part and the bottom part. Depending on the structure of the internal combustion engine, the position where the speed of the piston increases is a position corresponding to a lower part of the groove-like cooling water channel of the cylinder bore. In that case, it is desirable to insulate the lower part of the groove-like cooling water channel. Therefore, it is appropriately selected to which position from the bottom part of the groove-like cooling water channel is insulated by the cylinder bore wall thermal insulator of the second form of the present invention, that is, in which position in the up-down direction of the groove-like cooling water channel the position of the upper end of the rubber member is set.

The cylinder bore wall thermal insulator of the second form of the present invention is a cylinder bore wall thermal insulator for insulating all of the wall surfaces on the cylinder bore side of the groove-like cooling water channel or a part of the wall surfaces on the cylinder bore side of the groove-like cooling water channel when viewed in the circumferential direction. That is, the cylinder bore wall thermal insulator of the second form of the present invention is a cylinder bore wall thermal insulator for insulating all of bore walls of all the cylinder bores or a part of the bore walls of all the cylinder bores when viewed in the circumferential direction. Examples of the cylinder bore wall thermal insulator of the present invention include a thermal insulator for insulating a one-side half of the bore walls of all the cylinder bores as in a form example shown in FIG. 18, a thermal insulator for insulating a part on one side among the bore walls of all the cylinder bores as in a form example shown in FIG. 29, and a thermal insulator for insulating all of the bore walls of all the cylinder bores as in a form example shown in FIG. 30. Note that, in the present invention, a one-side half or a part of one side means a one-side half or a part of one side in the circumferential direction of the cylinder bore wall or the groove-like cooling water channel.

The cylinder bore wall thermal insulator of the second form of the present invention includes the base member, the heat-sensitive expanding rubber, and the rear-surface metal plate.

The base member related to the cylinder bore wall thermal insulator of the second form of the present invention is made of synthetic resin. When viewed from above, the base member has a shape of continuous two or more arcs and has a shape of continuously connected arcs over a range insulated by the heat-sensitive expanding rubber. That is, the base member is a molded body of synthetic resin molded into a shape conforming to the shape of the groove-like cooling water channel in which the cylinder bore wall thermal insulator of the second form of the present invention is set.

The base member is a member to which the rear-surface metal plate is fixed and is a member for holding the outer edge portion of the heat sensitive expanding rubber between the circumferential edge portion of the opening for heat-sensitive expanding rubber swelling of the base member and the rear-surface metal plate in order to fix the heat-sensitive expanding rubber to the base member. That is, the base member is a member to which the heat-sensitive expanding rubber is fixed. The base member is a member, the position of which in the groove-like cooling water channel is fixed after heat-sensitive expansion by an elastic force of the heat-sensitive expanding rubber to thereby position the heat-sensitive expanding rubber in the groove-like cooling water channel.

In the base member, the opening for heat-sensitive expanding rubber swelling for enabling the heat-sensitive expanding rubber disposed on the rear surface side of the base member to pass through the base member during heat-sensitive expansion and swell further to the inner side than the inner side surface of the base member to allow the contact surface of the heat-sensitive expanding rubber to come into contact with the cylinder bore wall of the groove-like cooling water channel is formed for each of bore sections. Therefore, the opening for heat-sensitive expanding rubber swelling is formed in a position opposed to each of the bore walls of the cylinder bores set as thermal insulation targets. Note that, in the present invention, the bore walls of the cylinder bores indicate bore wall portions corresponding to individual cylinder bores. The bore sections of the base member mean portions of the base member on one bore wall side of the cylinder bores and is equivalent to one arcuate shape forming the base member when viewed from above.

The synthetic resin forming the base member is not particularly limited and is selected as appropriate if the synthetic resin is synthetic resin usually used in a cylinder bore wall thermal insulator or a water jacket spacer set in a groove-like cooling water channel of a cylinder block of an internal combustion engine.

In the cylinder bore wall thermal insulator of the second form of the present invention, a contact member projecting from the rear surface of the base member and for coming into contact with a counter wall of the cylinder bore wall is attached to the rear surface side of base member. The contact member may be a contact member molded integrally with the base member or may be a contact member manufactured separately from the base member. That is, when the base member is molded, the contact member may be attached to the rear surface side of the base member by integrally molding the base member and the contact member or the contact member may be attached to the rear surface side of the base member by molding the base member first and then fixing a separately manufactured contact member to the base member. The material of the contact member is not particularly limited. However, when the contact member is molded integrally with the base member, the material of the contact member is synthetic resin of the same material as the material of the base member. When the contact member manufactured separately from the base member is fixed to the base member, examples of the material of the contact member include synthetic resin, stainless steel (SUS), and an aluminum alloy.

An attaching position of the contact member is selected as appropriate. Examples of the attaching position include a range extending over the center when viewed in the arc direction on the upper side of the bore sections of the base member and the vicinity of the center and a range extending over the center when viewed in the arc direction on the lower side of the bore sections of the base member and the vicinity of the center and, in addition to those positions, the vicinity of an end side when viewed in the arc direction on the upper side of the bore sections of the base member and the vicinity of an end side when viewed in the arc direction on the lower side of the core sections of the base member. The number of contact members to be attached is selected as appropriate.

The heat-sensitive expanding rubber related to the cylinder bore wall thermal insulator of the second form of the present invention is a member for heat-sensitively expanding in the groove-like cooling water channel until the contact surface comes into contact with the cylinder bore wall of the groove-like cooling water channel and covering the cylinder bore wall to thereby insulate the cylinder bore wall. The heat-sensitive expanding rubber is molded into a shape that can cover the opening for heat-sensitive expanding rubber swelling from the rear surface side of the base member. The heat-sensitive expanding rubber is disposed such that the outer edge portion is held between the circumferential edge portion of the opening for heat-sensitive expanding rubber swelling of the base member and the rear-surface metal plate and fixed to the base member, whereby the heat-sensitive expanding rubber covers the opening for heat-sensitive expanding rubber swelling of the base member from the rear surface side. The heat-sensitive expanding rubber passes through the opening for heat-sensitive expanding rubber swelling from the rear surface side to the inner side of the base member during heat-sensitive expansion and swells further to the inner side than the inner side surface of the base member and expands until the heat-sensitive expanding rubber comes into contact with the cylinder bore wall of the groove-like cooling water channel.

The heat-sensitive expanding rubber is a rubber material that is in a state in which a base form material is compressed and bound by a thermoplastic substance before expansion and, by being heated, is released from the binding by thermoplastic resin and expands to a state before the compression, that is, a release state. The heat-sensitive expanding rubber (in the compressed state) is a composite body obtained by impregnating a thermoplastic substance having a lower melting point than a base form material in the base form material and compressing the thermoplastic substance. The heat-sensitive expanding rubber is a material, a compressed state of which is maintained by a hardened object of the thermoplastic substance present at least in a surface layer part thereof at the normal temperature and is released when the hardened object of the thermoplastic substance is softened by heating. Examples of the heat-sensitive expanding rubber include heat-sensitive expanding rubber described in Japanese Patent Laid-Open No. 2004-143262.

Examples of the base form material related to the heat-sensitive expanding rubber include various polymeric materials such as rubber, elastomer, thermoplastic resin, and thermosetting resin. Specifically, examples of the base form material include natural rubber, various synthetic rubbers such as chloropropylene rubber, styrene butadiene rubber, nitrile butadiene rubber, ethylene propylene diene terpolymer, silicone rubber, fluorocarbon rubber, and acrylic rubber, various elastomers such as soft urethane, and various thermosetting resins such as hard urethane, phenolic resin, and melamine resin.

As the thermoplastic substance related to the heat-sensitive expanding rubber, a thermoplastic substance, any one of a glass transition point, a melting point, and a softening temperature of which is lower than 120° C., is desirable. Examples of the thermoplastic substance related to the heat-sensitive expanding rubber include thermoplastic resin such as polyethylene, polypropylene, polystyrene, polyvinyl chloride, polyvinylidene chloride, polyvinyl acetate, polyacrylic ester, styrene butadiene copolymer, chlorinated polyethylene, polyvinylidene fluoride, ethylene-vinyl acetate copolymer, ethylene vinyl chloride acrylate copolymer, ethylene-vinyl acetate copolymer, ethylene-vinyl acetate copolymer, nylon, acrylonitrile-butadiene copolymer, polyacrylonitrile, polyvinyl chloride, polychloroprene, polybutadiene, thermoplastic polyimide, polyacetal, polyphenylene sulfide, polycarbonate, and thermoplastic polyurethane and various thermoplastic substances such as low-melting point glass flit, starch, solder, and wax and metal materials such as cast iron, stainless steel, and aluminum.

The thickness of the heat-sensitive expanding rubber is selected as appropriate considering the coefficient of expansion of the heat-sensitive expanding rubber, the width of the groove-like cooling water channel, the distance between the inner side surface of the base member and the cylinder bore wall, the distance between the inner side surface of the rear-surface metal plate and the cylinder bore wall, and the like.

The rear-surface metal plate related to the cylinder bore wall thermal insulator of the second form of the present invention is made of metal and is a molded body of a metal plate. The rear-surface metal plate covers the rear surface side of the heat-sensitive expanding rubber. The shape of the rear-surface metal plate is an arcuate shape when viewed from above. The rear-surface metal plate is a member that holds the outer edge portion of the heat-sensitive expanding rubber between the member and the circumferential edge portion of the opening for heat-sensitive expanding rubber swelling of the base member to thereby fix the heat-sensitive expanding rubber to the base member and prevent the heat-sensitive expanding rubber from expanding to the rear surface side of the base member.

The metal forming the rear-surface metal plate is not particularly limited and is selected as appropriate if the metal is metal usually used in a cylinder bore wall thermal insulator or a water jacket spacer set in a groove-like cooling water channel of a cylinder block of an internal combustion engine. Examples of the material of the rear-surface metal plate include stainless steel (SUS), an aluminum alloy, soft steel, hard steel, and alloy steel.

A method of fixing the rear-surface metal plate to the base member is not particularly limited. Examples of the method include a method of forming bending sections in the rear-surface metal plate, bending the bending sections, and holding the end portion of the base member between the bent bending sections and the rear-surface metal plate to thereby fix the rear-surface metal plate, a method of forming fitting openings in the rear-surface metal plate and fitting the fitting openings with fitting protrusions formed in the base member to thereby fix the rear-surface metal plate, a method of fixing the rear-surface metal plate with metal fittings, a method of fixing the rear-surface metal plate with rivets, and a combination of these methods. That is, the rear-surface metal plate is fixed to the base member via parts for fixing formed in the rear-surface metal plate.

After the cylinder bore wall thermal insulator of the second form of the present invention is set in the groove-like cooling water channel of the cylinder block, the heat-sensitive expanding rubber heat-sensitively expands, whereby the contact member comes into contact with the counter wall of the cylinder bore wall of the groove-like cooling water channel. In a state in which the contact member is in contact with the counter wall of the cylinder bore wall, that is, in a state in which the position on the rear surface side of the heat-sensitive expanding rubber is fixed, the contact surface of the heat-sensitive expanding rubber is pressed toward the cylinder bore wall of the groove-like cooling water channel by an elastic force generated by further expansion of the heat-sensitive expanding rubber. Consequently, the contact surface of the heat-sensitive expanding rubber adheres to the cylinder bore wall of the groove-like cooling water channel and covers the cylinder bore wall of the groove-like cooling water channel. The cylinder bore wall is insulated.

The cylinder bore wall thermal insulator of the second form of the present invention can include a pressing member erected on the base member upward from the base member. The pressing member is a member, the upper end of which comes into contact with a cylinder head or a cylinder head gasket to thereby restrict movement in the up-down direction of the cylinder bore wall thermal insulator of the present invention in the groove-like cooling water channel when the cylinder bore wall thermal insulator of the second form of the present invention is set in the groove-like cooling water channel.

When the cylinder bore wall thermal insulator of the second form of the present invention is inserted to be set in the groove-like cooling water channel, the heat-sensitive expanding rubber has not expanded yet. Therefore, the width of the cylinder bore wall thermal insulator of the present invention is smaller than the channel width of the groove-like cooling water channel. Therefore, when the cylinder bore wall thermal insulator of the second form of the present invention is inserted into the groove-like cooling water channel, the cylinder bore wall thermal insulator of the second form of the present invention can be set in the groove-like cooling water channel without large resistance.

As in the form example shown in FIG. 18, the cylinder bore wall thermal insulator of the second form of the present invention can include a cooling-water-flow partitioning member on one end side. The cylinder bore wall thermal insulator of the second form of the present invention can also include another member or the like for adjusting a flow of cooling water.

Figure 29:
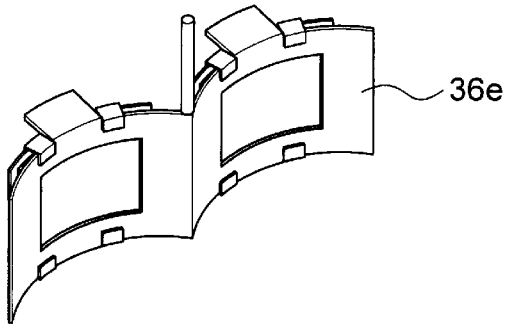
FIG. 29 is a schematic view showing a form example of the cylinder bore wall thermal insulator of the present invention.
Figure 29:
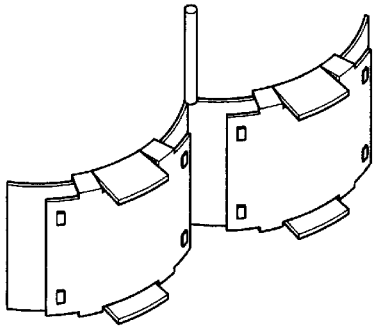
Figure 30:
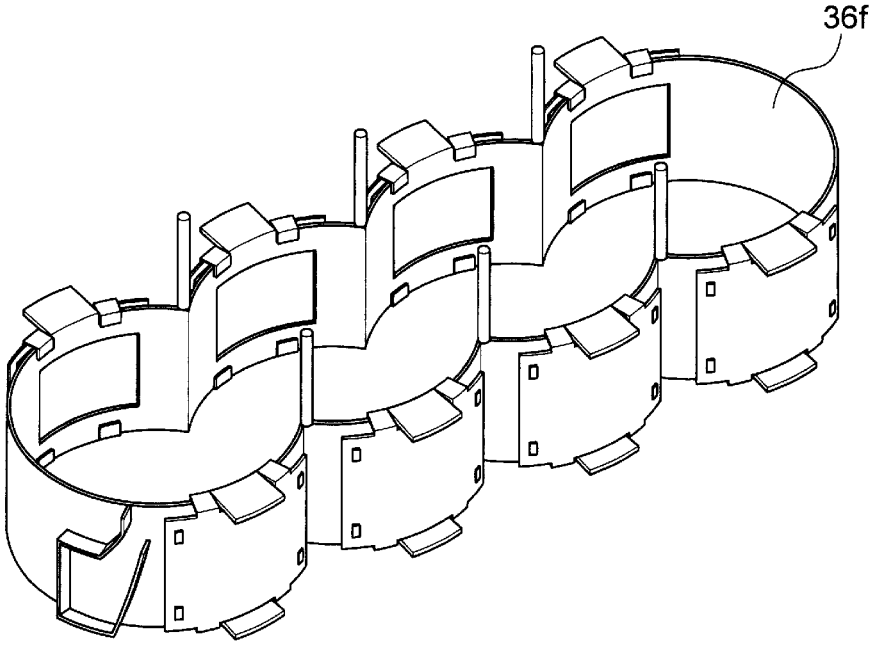
FIG. 30 is a schematic view showing a form example of the cylinder bore wall thermal insulator of the present invention.

The cylinder bore wall thermal insulator 36*d* shown in FIG. 18 is a thermal insulator for thermal insulation of bore walls in a one-side half among all the cylinder bore walls of the cylinder block 11 shown in FIG. 4. However, examples of the cylinder bore wall thermal insulator of the first form of the present invention include a thermal insulator for thermal insulation of a part of bore walls on one side among all the cylinder bore walls as in a form example shown in FIG. 29. A cylinder bore wall thermal insulator 36*e* shown in FIG. 29 is a thermal insulator for thermal insulation of a part of the bore walls 21*a* in a one-side half of the cylinder block 11 shown in FIG. 4, that is, bore walls of the cylinder bores 12*b*1 and 12*b*2. Note that FIG. 29 is a schematic perspective view of a form example of the cylinder bore wall thermal insulator of the second form of the present invention. FIG. 29(A) is a perspective view of the cylinder bore wall thermal insulator viewed from obliquely above on the inner side. FIG. 29(B) is a perspective view of the cylinder bore wall thermal insulator viewed from obliquely above on the rear surface side. Examples of the cylinder bore wall thermal insulator of the second form of the present invention include a thermal insulator for thermal insulation of all bore walls of all cylinder bores as in a form example shown in FIG. 30. A cylinder bore wall thermal insulator 36*f* shown in FIG. 30 is a thermal insulator for thermal insulation of all the bore walls of all the cylinder bores of the cylinder block 11 shown in FIG. 4. That is, the cylinder bore wall thermal insulator of the first form of the present invention may be a thermal insulator for thermal insulation of all bore walls of all cylinder bores of a cylinder block or may be a thermal insulator for thermal insulation of a part, for example, a one-side half or a part of one side of the bore walls of all the cylinder bores of the cylinder block. Note that FIG. 30 is a schematic perspective view of a form example of the cylinder bore wall thermal insulator of the second form of the present invention.

An internal combustion engine of the present invention includes a cylinder block in which a groove-like cooling water channel is formed, wherein the cylinder bore wall thermal insulator of the present invention (the cylinder bore wall thermal insulator of the first form of the present invention or the cylinder bore wall thermal insulator of the second form of the present invention) is set in the groove-like cooling water channel.

A cylinder block related to the internal combustion engine of the present invention is the same as the cylinder block related to the cylinder bore wall thermal insulator of the present invention.

The internal combustion engine of the present invention includes a cylinder head, a camshaft, a valve, a piston, a connecting rod, and a crankshaft besides the cylinder block and the cylinder bore wall thermal insulator of the present invention set in the groove-like cooling water channel of the cylinder block.

An automobile of the present invention is an automobile including the internal combustion engine of the present invention.

INDUSTRIAL APPLICABILITY

According to the present invention, it is possible to provide a cylinder bore wall thermal insulator that has high adhesion to a wall surface on a cylinder bore side of a groove-like cooling water channel of a cylinder block and less easily causes positional deviation in the groove-like cooling water channel.

REFERENCE SIGNS LIST

8 bottom part
9 top part
10 position near the middle
11, 11*a*, 11*b* cylinder block
12 bore
12*a*1, 12*a*2 end bore
12*b*1, 12*b*2 intermediate bore
13 cylinder bore wall
14 groove-like cooling water channel
15 cooling water supply port
16 cooling water discharge port
17 cylinder bore wall
17*a*, 17*b* wall surface in the one-side half
18 counter wall of a cylinder bore wall
21*a*, 21*b* bore wall in a one-side half
23*a*1, 23*a*2, 23*b*1, 23*b*2 bore wall of a cylinder bore
26 contact surface of heat-sensitive expanding rubber
30 contact member
31 rear-surface metal plate
32 urging member
33 opening for heat-sensitive expanding rubber swelling
34*a*, 34*b* base member
35 heat-sensitive expanding rubber
36*a*, 36*b*, 36*c*, 36*d*, 36*e*, 36*f* cylinder bore wall thermal insulator
37 bending section
38 fitting opening
39 pressing member
40 outer edge portion of the heat-sensitive expanding rubber
41 contour of the rear-surface metal plate
42 contour of the heat-sensitive expanding rubber
44 fitting protrusion
45 cooling-water-flow partitioning member
46 circumferential edge portion of the opening for heat-sensitive expanding rubber swelling
191 inter-bore section
192 boundary between bore walls of cylinder bores of the wall surface on the cylinder bore side of the groove-like cooling water channel
O center axis of a cylinder bore

The invention claimed is:

1. A cylinder bore wall thermal insulator set in a groove-like cooling water channel of a cylinder block of an internal combustion engine including cylinder bores and for insulating all bore walls of all the cylinder bores or a part of the bore walls of all the cylinder bores, the thermal insulator comprising:

a base member made of synthetic resin and having a shape conforming to a shape of the groove-like cooling water channel in a setting position of the thermal insulator, an opening for heat-sensitive expanding rubber swelling for heat-sensitive expanding rubber disposed on a rear surface side to pass through the base member during heat-sensitive expansion being formed in a position opposed to an insulating part of a cylinder bore wall;

a heat-sensitive expanding rubber disposed on the rear surface side of the base member and covering the opening for heat-sensitive expanding rubber swelling;

a rear-surface metal plate covering the rear surface side of the heat-sensitive expanding rubber, fixed to the base member, and holding an outer edge portion of the heat-sensitive expanding rubber between the rear-surface metal plate and the base member to thereby fix the heat-sensitive expanding rubber to the base member; and a spring or an elastic rubber for urging the heat-sensitive expanding rubber after the heat-sensitive expansion toward the cylinder bore wall is attached to the rear-surface metal plate, wherein a width of the cylinder bore wall thermal insulator before the heat-sensitive expanding rubber expands is smaller than a channel width of the groove-like cooling water channel, and the expanded heat-sensitive expanding rubber contacts with the cylinder bore wall and presses the spring toward the counter wall of the cylinder bore wall.

2. A cylinder bore wall thermal insulator set in a groove-like cooling water channel of a cylinder block of an internal combustion engine including cylinder bores and for insulating all bore walls of all the cylinder bores or a part of the bore walls of all the cylinder bores, the thermal insulator comprising:

a base member made of synthetic resin and having a shape conforming to a shape of the groove-like cooling water channel in a setting position of the thermal insulator, an opening for heat-sensitive expanding rubber swelling for heat-sensitive expanding rubber disposed on a rear surface side to pass through the base member during heat-sensitive expansion being formed in a position opposed to an insulating part of a cylinder bore wall;

a heat-sensitive expanding rubber disposed on the rear surface side of the base member and covering the opening for heat-sensitive expanding rubber swelling;

a rear-surface metal plate covering the rear surface side of the heat-sensitive expanding rubber, fixed to the base member, and holding an outer edge portion of the heat-sensitive expanding rubber between the rear-surface metal plate and the base member to thereby fix the heat-sensitive expanding rubber to the base member; and a board projecting from the rear surface of the base member and for coming into contact with a counter wall of the cylinder bore wall is attached to the rear surface side of base member, wherein a width of the cylinder bore wall thermal insulator before the heat-sensitive expanding rubber expands is smaller than a channel width of the groove-like cooling water channel, and the expanded heat-sensitive expanding rubber contacts with the cylinder bore wall and presses the spring toward the counter wall of the cylinder bore wall.

3. The cylinder bore wall thermal insulator according to claim 1, the cylinder bore wall thermal insulator set in a groove-like cooling water channel of a cylinder block of an internal combustion engine including cylinder bores and for insulating all bore walls of all the cylinder bores or a part of the bore walls of all the cylinder bores, wherein the heat-sensitive expanding rubber is made of a base form material and a thermoplastic substance, and the base form material is silicon rubber, fluorocarbon rubber, natural rubber, butadiene rubber, ethylene propylene diene rubber, or nitrile butadiene rubber, and the thermoplastic substance is resin or a metal material.

4. An internal combustion engine comprising a cylinder block in which a groove-like cooling water channel is formed, wherein the cylinder bore wall thermal insulator according to claim 1 is set in the groove-like cooling water channel.

5. An automobile comprising the internal combustion engine according to claim 4.

6. The cylinder bore wall thermal insulator according to claim 2, the cylinder bore wall thermal insulator set in a groove-like cooling water channel of a cylinder block of an internal combustion engine including cylinder bores and for insulating all bore walls of all the cylinder bores or a part of the bore walls of all the cylinder bores, wherein the heat-sensitive expanding rubber is made of a base form material and a thermoplastic substance, and the base form material is silicon rubber, fluorocarbon rubber, natural rubber, butadiene rubber, ethylene propylene diene rubber, or nitrile butadiene rubber, and the thermoplastic substance is resin or a metal material.

7. An internal combustion engine comprising a cylinder block in which a groove-like cooling water channel is formed, wherein the cylinder bore wall thermal insulator according to claim 2 is set in the groove-like cooling water channel.

8. An internal combustion engine comprising a cylinder block in which a groove-like cooling water channel is formed, wherein the cylinder bore wall thermal insulator according to claim 3 is set in the groove-like cooling water channel.

* * * * *